US007607241B2

(12) United States Patent
McDonald et al.

(10) Patent No.: US 7,607,241 B2
(45) Date of Patent: Oct. 27, 2009

(54) ARTICLE OF FOOTWEAR WITH AN ARTICULATED SOLE STRUCTURE

(75) Inventors: Steven McDonald, Heber, UT (US); Tobie D. Hatfield, Lake Oswego, OR (US)

(73) Assignee: NIKE, Inc., Beaverton, OR (US)

( * ) Notice: Subject to any disclaimer, the term of this patent is extended or adjusted under 35 U.S.C. 154(b) by 30 days.

(21) Appl. No.: 11/869,604

(22) Filed: Oct. 9, 2007

(65) Prior Publication Data

US 2008/0022553 A1 Jan. 31, 2008

Related U.S. Application Data

(63) Continuation of application No. 11/098,022, filed on Apr. 1, 2005, now Pat. No. 7,290,357, which is a continuation-in-part of application No. 10/862,056, filed on Jun. 4, 2004, now Pat. No. 7,451,557, which is a continuation-in-part of application No. 10/681,321, filed on Oct. 9, 2003, now Pat. No. 6,990,755.

(51) Int. Cl.
*A43B 1/10* (2006.01)
*A43B 13/12* (2006.01)

(52) U.S. Cl. ..... 36/102; 36/30 R; 36/59 R; 36/103; 36/59 A

(58) Field of Classification Search ..... 36/102, 36/30 R, 59 R, 103, 59 A, 25 R, 7.6
See application file for complete search history.

(56) References Cited

U.S. PATENT DOCUMENTS

| | | | | |
|---|---|---|---|---|
| 500,385 | A | 6/1893 | Hall | |
| 997,657 | A | 7/1911 | Drake | |
| 1,219,507 | A | 3/1917 | Teare | |
| 2,155,166 | A | 4/1939 | Kraft | |
| 2,188,168 | A | 1/1940 | Winkel | |
| 2,224,590 | A | 12/1940 | Boivin | |
| 3,019,534 | A * | 2/1962 | Kauffman et al. | 36/15 |

(Continued)

FOREIGN PATENT DOCUMENTS

| | | |
|---|---|---|
| BE | 493654 | 6/1950 |

(Continued)

OTHER PUBLICATIONS

European Search Report in corresponding European Application, Application No. 07025158.2, dated Apr. 15, 2008.

(Continued)

*Primary Examiner*—Ted Kavanaugh
(74) *Attorney, Agent, or Firm*—Banner & Witcoff, Ltd.

(57) ABSTRACT

An article of footwear is disclosed that includes an upper and a sole structure secured to the upper. The sole structure includes a connecting portion positioned adjacent the upper and extending along a longitudinal length of the upper. A plurality of discrete sole elements extend downward from the connecting portion. The sole elements define a lower surface, and the sole elements are separated by a plurality of sipes that extend upward from the lower surface and into the sole structure. An outsole may be located within the sipes or grooves and extend between the sole elements, with a lower portion of the outsole extending beyond the lower surface of the sole elements.

23 Claims, 24 Drawing Sheets

U.S. PATENT DOCUMENTS

| | | | | |
|---|---|---|---|---|
| 3,087,261 | A | 4/1963 | Russell | |
| 3,295,230 | A | 1/1967 | Szerenyi et al. | |
| 3,373,510 | A | 3/1968 | Memole, et al. | |
| 3,538,628 | A | 11/1970 | Einstein, Jr. | |
| 3,846,919 | A | 11/1974 | Milotic | |
| 4,059,910 | A | 11/1977 | Bryden et al. | |
| 4,241,524 | A | 12/1980 | Sink | |
| 4,265,032 | A | 5/1981 | Levine | |
| 4,302,892 | A | 12/1981 | Adamik | |
| 4,309,831 | A | 1/1982 | Pritt | |
| 4,309,832 | A | 1/1982 | Hunt et al. | |
| 4,420,894 | A | 12/1983 | Glassman | |
| 4,538,368 | A | 9/1985 | Mugford | |
| 4,638,577 | A | 1/1987 | Riggs | |
| D294,537 | S | 3/1988 | Le | |
| D294,653 | S | 3/1988 | Le | |
| 4,745,693 | A | 5/1988 | Brown | |
| 4,825,563 | A | 5/1989 | Strongwater | |
| 4,850,122 | A | 7/1989 | Schwab, Jr. | |
| 4,887,369 | A | 12/1989 | Bailey et al. | |
| 4,908,964 | A | 3/1990 | Deem | |
| 4,936,028 | A * | 6/1990 | Posacki | 36/15 |
| 4,974,344 | A | 12/1990 | Ching | |
| 5,083,385 | A | 1/1992 | Halford | |
| 5,367,791 | A | 11/1994 | Gross et al. | |
| 5,381,610 | A | 1/1995 | Hanson | |
| 5,410,821 | A | 5/1995 | Hilgendorf | |
| 5,533,280 | A | 7/1996 | Halliday | |
| D378,472 | S | 3/1997 | Barmani | |
| 5,661,915 | A | 9/1997 | Smith | |
| 5,784,808 | A | 7/1998 | Hockerson | |
| 5,799,417 | A | 9/1998 | Burke et al. | |
| 5,822,888 | A | 10/1998 | Terry | |
| 5,915,820 | A | 6/1999 | Kraeuter et al. | |
| 5,991,950 | A | 11/1999 | Schenkel | |
| 6,023,857 | A | 2/2000 | Vizy et al. | |
| 6,023,859 | A | 2/2000 | Burke et al. | |
| 6,065,230 | A | 5/2000 | James et al. | |
| 6,079,126 | A | 6/2000 | Olszewski | |
| 6,115,945 | A | 9/2000 | Ellis et al. | |
| 6,145,221 | A | 11/2000 | Hockerson | |
| 6,202,325 | B1 | 3/2001 | Kim | |
| 6,446,359 | B2 * | 9/2002 | Tomat | 36/3 R |
| 6,487,795 | B1 | 12/2002 | Ellis, III | |
| 6,581,303 | B1 * | 6/2003 | Tuan | 36/3 B |
| 6,782,642 | B2 * | 8/2004 | Knoche et al. | 36/129 |
| 7,168,190 | B1 | 1/2007 | Gillespie | |
| 7,290,357 | B2 * | 11/2007 | McDonald et al. | 36/102 |
| 2003/0046830 | A1 | 3/2003 | Ellis, III | |
| 2003/0051372 | A1 | 3/2003 | Lyden | |
| 2003/0069807 | A1 | 4/2003 | Lyden | |
| 2005/0076536 | A1 | 4/2005 | Hatfield et al. | |
| 2005/0262739 | A1 | 12/2005 | McDonald et al. | |
| 2005/0268491 | A1 | 12/2005 | McDonald et al. | |

FOREIGN PATENT DOCUMENTS

| | | |
|---|---|---|
| DE | 92 08 153 U1 | 12/1992 |
| DE | 296 02 610 | 5/1996 |
| DE | 299 19 124.9 | 11/1999 |
| EP | 1 002 475 | 5/2000 |
| FR | 2 813 766 | 3/2002 |
| GB | 471179 | 8/1937 |
| GB | 2 340 378 | 2/2000 |
| WO | 91/03180 | 3/1991 |
| WO | 91/05491 | 5/1991 |
| WO | 91/11924 | 8/1991 |
| WO | 91/19429 | 12/1991 |
| WO | 92/07483 | 5/1992 |
| WO | 94/03080 | 2/1994 |
| WO | 97/46127 | 12/1997 |
| WO | 2004/066771 | 8/2004 |
| WO | 2004/103105 | 12/2004 |

OTHER PUBLICATIONS

International Search Report in corresponding PCT application No. PCT/US2006/034211, mailed Jan. 11, 2007.

* cited by examiner

ARTICLE OF FOOTWEAR WITH AN ARTICULATED SOLE STRUCTURE

CROSS-REFERENCE TO RELATED APPLICATION

This U.S. Patent Application is a continuation application of and claims priority to co-pending U.S. patent application Ser. No. 11/098,022, which was filed in the U.S. Patent and Trademark Office on Apr. 1, 2005 and entitled Article Of Footwear With An Articulated Sole Structure, which is a continuation-in-part application of and claims priority to (1) U.S. patent application Ser. No. 10/681,321, which was filed in the U.S. Patent and Trademark Office on Oct. 9, 2003 and entitled Article of Footwear With A Stretchable Upper And An Articulated Sole Structure and (2) U.S. patent application Ser. No. 10/862,056, which was filed in the U.S. Patent and Trademark Office on Jun. 4, 2004 and entitled Article of Footwear With A Removable Midsole Element, such prior U.S. Patent Applications being entirely incorporated herein by reference.

BACKGROUND OF THE INVENTION

1. Field of the Invention

The present invention relates to the field of footwear. The invention concerns, more particularly, an article of footwear having a stretchable upper and a sole structure with a plurality of incisions that impart an articulated configuration with flexibility in selected directions.

2. Description of Background Art

Conventional articles of athletic footwear include two primary elements, an upper and a sole structure. The upper provides a covering for the foot that securely receives and positions the foot with respect to the sole structure. In addition, the upper may have a configuration that protects the foot and provides ventilation, thereby cooling the foot and removing perspiration. The sole structure is secured to a lower surface of the upper and is generally positioned between the foot and the ground. In addition to attenuating ground reaction forces, the sole structure may provide traction and control potentially harmful foot motion, such as over pronation. Accordingly, the upper and the sole structure operate cooperatively to provide a comfortable structure that is suited for a wide variety of ambulatory activities, such as walking and running. The general features and configuration of the upper and the sole structure are discussed in greater detail below.

The upper forms a void on the interior of the footwear for receiving the foot. The void has the general shape of the foot, and access to the void is provided by an ankle opening. Accordingly, the upper extends over the instep and toe areas of the foot, along the medial and lateral sides of the foot, and around the heel area of the foot. A lacing system is often incorporated into the upper to selectively increase the size of the ankle opening and permit the wearer to modify certain dimensions of the upper, particularly girth, to accommodate feet with varying proportions. In addition, the upper may include a tongue that extends under the lacing system to enhance the comfort of the footwear, and the upper may include a heel counter to limit movement of the heel.

Various materials may be utilized in manufacturing the upper. The upper of an article of athletic footwear, for example, may be formed from multiple material layers including an exterior layer, a middle layer, and an interior layer. The materials forming the exterior layer of the upper may be selected based upon the properties of wear-resistance, flexibility, and air-permeability, for example. With regard to the exterior layer, the toe area and the heel area may be formed of leather, synthetic leather, or a rubber material to impart a relatively high degree of wear-resistance. Leather, synthetic leather, and rubber materials may not exhibit the desired degree of flexibility and air-permeability. Accordingly, various other areas of the exterior layer of the upper may be formed from a synthetic textile. The exterior layer of the upper may be formed, therefore, from numerous material elements that each impart different properties to specific areas of the upper.

A middle layer of the upper may be formed from a lightweight polymer foam material that attenuates ground reaction forces and protects the foot from objects that may contact the upper. Similarly, an interior layer of the upper may be formed of a moisture-wicking textile that removes perspiration from the area immediately surrounding the foot. In some articles of athletic footwear, the various layers may be joined with an adhesive, and stitching may be utilized to join elements within a single layer or to reinforce specific areas of the upper.

The sole structure generally incorporates multiple layers that are conventionally referred to as an insole, a midsole, and an outsole. The insole is a thin, comfort-enhancing member located within the upper and adjacent the plantar (lower) surface of the foot to enhance footwear comfort. The midsole, which is traditionally attached to the upper along the entire length of the upper, forms the middle layer of the sole structure and serves a variety of purposes that include controlling foot motions and attenuating ground reaction forces. The outsole forms the ground-contacting element of footwear and is usually fashioned from a durable, wear-resistant material that includes texturing to improve traction.

The primary element of a conventional midsole is a resilient, polymer foam material, such as polyurethane or ethylvinylacetate, that extends throughout the length of the footwear. The properties of the polymer foam material in the midsole are primarily dependent upon factors that include the dimensional configuration of the midsole and the specific characteristics of the material selected for the polymer foam, including the density of the polymer foam material. By varying these factors throughout the midsole, the relative stiffness, degree of ground reaction force attenuation, and energy absorption properties may be altered to meet the specific demands of the activity for which the footwear is intended to be used.

In addition to polymer foam materials, conventional midsoles may include, for example, stability devices that resist over-pronation and moderators that distribute ground reaction forces. The use of polymer foam materials in athletic footwear midsoles, while providing protection against ground reaction forces, may introduce instability that contributes to a tendency for over-pronation. Although pronation is normal, it may be a potential source of foot and leg injury, particularly if it is excessive. Stability devices are often incorporated into the polymer foam material of the midsoles to control the degree of pronation in the foot. Examples of stability devices are found in U.S. Pat. No. 4,255,877 to Bowerman; U.S. Pat. No. 4,287,675 to Norton et al.; U.S. Pat. No. 4,288,929 to Norton et al.; U.S. Pat. No. 4,354,318 to Frederick et al.; U.S. Pat. No. 4,364,188 to Turner et al.; U.S. Pat. No. 4,364,189 to Bates; and U.S. Pat. No. 5,247,742 to Kilgore et al. In addition to stability devices, conventional midsoles may include fluid-filled bladders, as disclosed in U.S. Pat. Nos. 4,183,156 and 4,219,945 to Rudy, for example.

SUMMARY OF THE INVENTION

Aspects of the present invention involves an article of footwear having an upper and a sole structure secured to the upper. The sole structure includes a connecting portion positioned adjacent the upper and extending along a longitudinal length of the upper. A plurality of discrete sole elements extend downward from the connecting portion. The sole elements define a lower surface, and the sole elements are separated by a plurality of sipes that extend upward from the lower surface and into the sole structure. An outsole may be located within the sipes and extend between the sole elements, with a lower portion of the outsole extending beyond the lower surface of the sole elements.

The outsole may exhibit a web configuration that defines a plurality of apertures extending around the sole elements. Side surfaces of the sole elements may form indentations, with the outsole extending into the indentations. In some embodiments, segments of the outsole exhibit a T-shaped configuration in cross-section. The outsole may have a cover portion that extends over the lower surface of at least a portion of the sole elements. The cover portion may be located in a heel region of the footwear. In addition, the cover portion may be located in a forefoot region of the footwear, and a portion of the cover portion extends along a medial side of the sole structure.

The advantages and features of novelty characterizing aspects of the present invention are pointed out with particularity in the appended claims. To gain an improved understanding of the advantages and features of novelty, however, reference may be made to the following descriptive matter and accompanying drawings that describe and illustrate various embodiments and concepts related to the invention.

DESCRIPTION OF THE DRAWINGS

The foregoing Summary of the Invention, as well as the following Detailed Description of the Invention, will be better understood when read in conjunction with the accompanying drawings.

DETAILED DESCRIPTION OF THE INVENTION

Introduction

The following discussion and accompanying figures disclose an article of footwear 10 in accordance with various aspects of the present invention. Footwear 10 is depicted in the figures and discussed below as having a configuration that is suitable for athletic activities, particularly running. The concepts disclosed with respect to footwear 10 may, however, be applied to footwear styles that are specifically designed for a wide range of other athletic activities, including basketball, baseball, football, soccer, walking, and hiking, for example, and may also be applied to various non-athletic footwear styles. Accordingly, one skilled in the relevant art will recognize that the concepts disclosed herein may be applied to a wide range of footwear styles and are not limited to the specific embodiments discussed below and depicted in the figures. In addition to footwear 10, an article of footwear 10' and another article of footwear 10" are disclosed below.

First Article of Footwear

Footwear 10 is depicted in FIGS. 1-7 and includes an upper 20 and a sole structure 30. Upper 20 is formed from various material elements that are stitched or adhesively-bonded together to form an interior void that comfortably receives a foot and secures the position of the foot relative to sole structure 30. Sole structure 30 is secured to a lower portion of upper 20 and provides a durable, wear-resistant component for attenuating ground reaction forces as footwear 10 impacts the ground.

Many conventional articles of footwear exhibit a configuration that controls the motion of the foot during running or other activities. A conventional sole structure, for example, may have a relatively stiff or inflexible construction that inhibits the natural motion of the foot. Upper 20 and sole structure 30 have a structure that cooperatively articulate, flex, stretch, or otherwise move to provide an individual with a sensation of natural, barefoot running. That is, upper 20 and sole structure 30 are configured to complement the natural motion of the foot during running or other activities. In contrast with barefoot running, however, sole structure 30 attenuates ground reaction forces to decrease the overall stress upon the foot.

Figure 1:
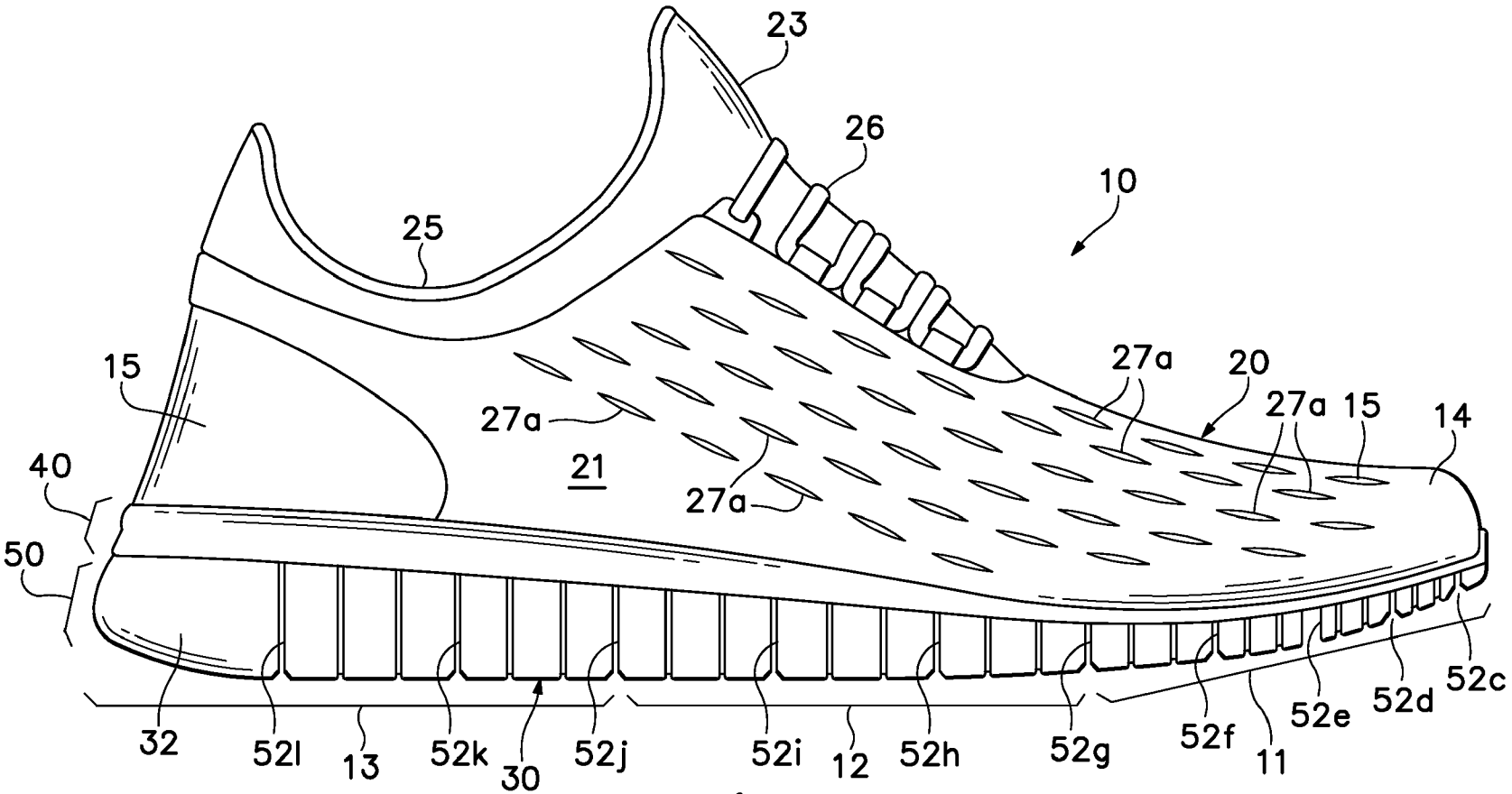
FIG. 1 is a lateral elevational view of a first article of footwear.
Figure 2:
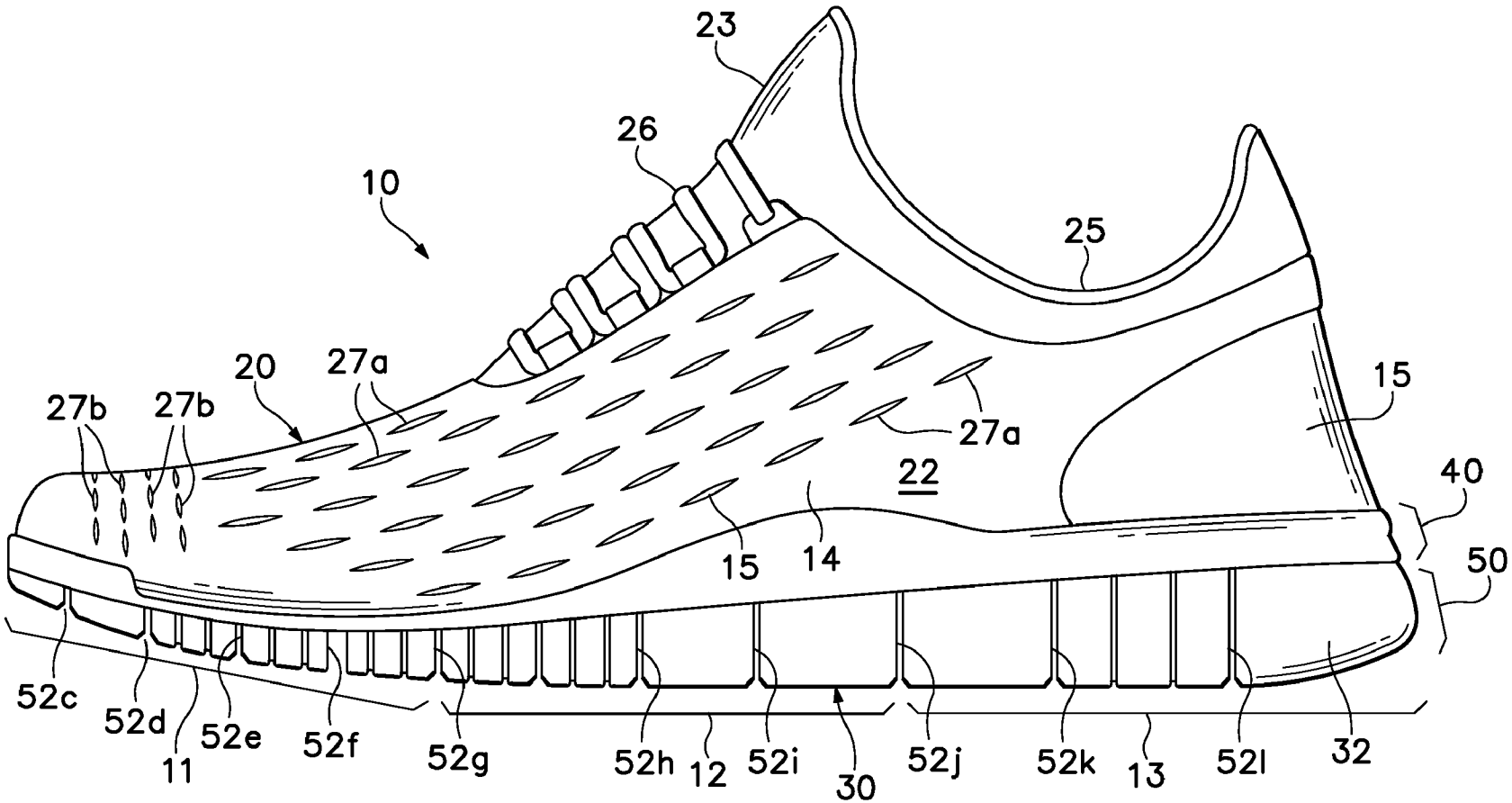
FIG. 2 is a medial elevational view of the first article of footwear.

For purposes of reference, footwear 10 may be divided into three general regions: a forefoot region 11, a midfoot region 12, and a heel region 13, as defined in FIGS. 1 and 2. Regions 11-13 are not intended to demarcate precise areas of footwear 10. Rather, regions 11-13 are intended to represent general areas of footwear 10 that provide a frame of reference during the following discussion. Although regions 11-13 apply generally to footwear 10, references to regions 11-13 may also apply specifically to upper 20, sole structure 30, or an individual component or portion within either of upper 20 or sole structure 30.

The various material elements forming upper 20, which will be described in greater detail below, combine to provide a structure having a lateral side 21, an opposite medial side 22, a tongue 23, and a lasting sock 24 that form the void within upper 20. Lateral side 21 extends through each of regions 11-13 and is generally configured to contact and cover a lateral surface of the foot. A portion of lateral side 21 extends over an instep of the foot and overlaps a lateral side of tongue 23. Medial side 22 has a similar configuration that generally corresponds with a medial surface of the foot. A portion of medial side 22 also extends over the instep of the foot and overlaps an opposite medial side of tongue 23. In addition, lateral side 21, medial side 22, and tongue 23 cooperatively form an ankle opening 25 in heel region 13 to provide the foot with access to the void within upper 20.

Tongue 23 extends longitudinally along upper 20 and is positioned to contact the instep area of the foot. Side portions of tongue 23 are secured to an interior surface of each of lateral side 21 and medial side 22. A lace 26 extends over tongue 23 and through apertures formed in lateral side 21 and medial side 22. Tongue 23 extends under lace 26 to separate lace 26 from the instep area of the foot. By increasing the tension in lace 26, the tension in lateral side 21 and medial side 22 may be increased so as to draw lateral side 21 and medial side 22 into contact with the foot. Similarly, by decreasing the tension in lace 26, the tension in lateral side 21 and medial side 22 may be decreased so as to provide additional volume for the foot within upper 20. This general configuration provides, therefore, a mechanism for adjusting the fit of upper 20 and accommodating various foot dimensions.

Figure 4A:
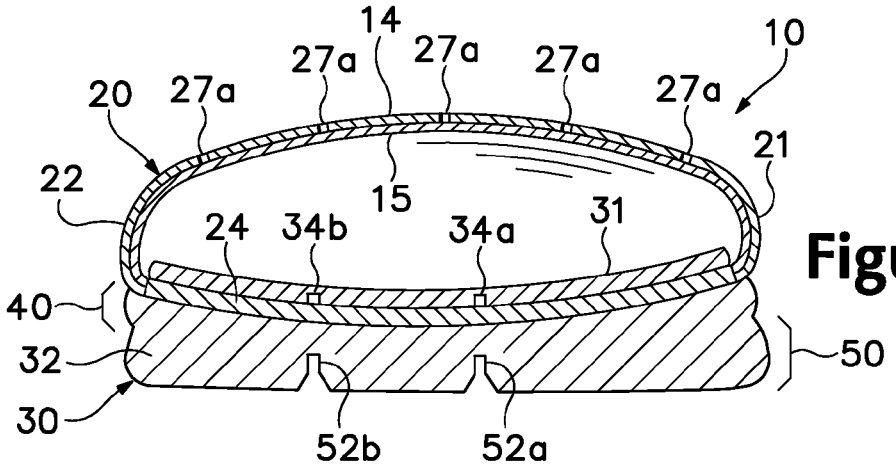
FIG. 4A is a first cross-sectional view of the first article of footwear, as defined by section line 4A-4A in FIG. 3.
Figure 4B:
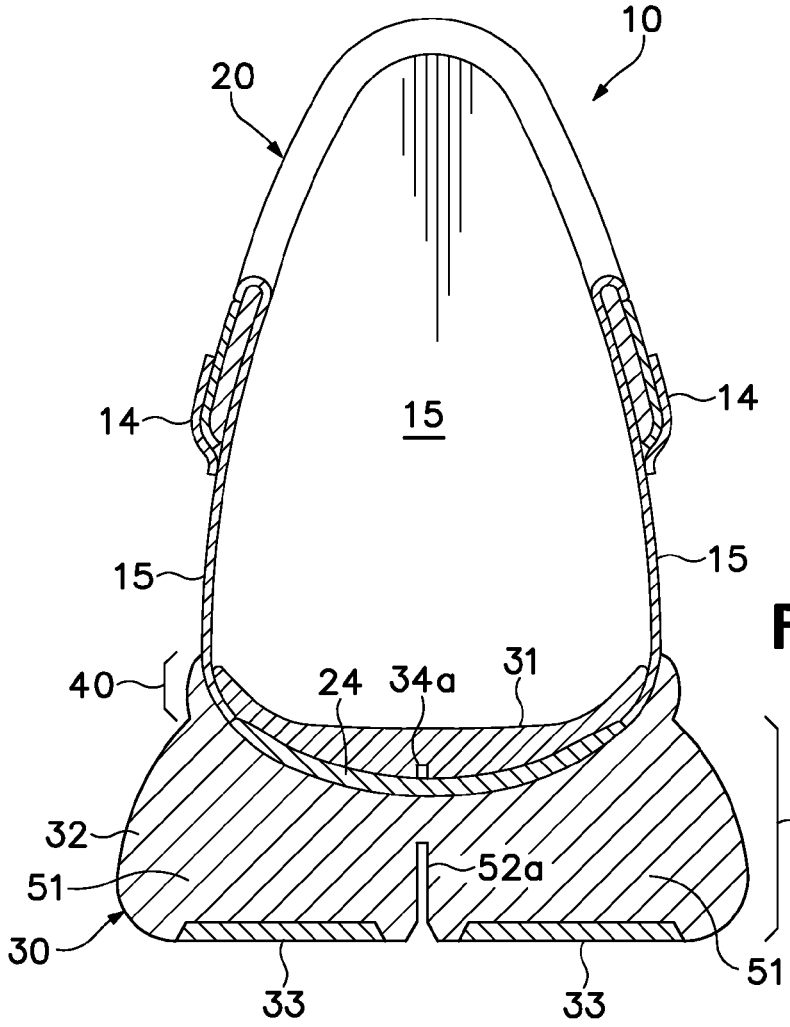
FIG. 4B is a second cross-sectional view of the first article of footwear, as defined by section line 4B-4B in FIG. 3.

A variety of materials are suitable for upper 20, including the materials that are conventionally utilized in footwear uppers. Accordingly, upper 20 may be formed from combinations of leather, synthetic leather, natural or synthetic textiles, polymer sheets, polymer foams, mesh textiles, felts, non-woven polymers, or rubber materials, for example. The exposed portions of upper 20 are formed from two coextensive layers of material that are stitched or adhesively bonded together. As depicted in FIGS. 4A and 4B, the layers include an exterior layer 14 and an adjacent interior layer 15. Exterior layer 14 is positioned on an exterior of upper 20, and interior layer 15 is positioned on an interior of upper 20 so as to form a surface of the void within upper 20. Lasting sock 24 is secured to a lower edge of layers 14 and 15 and extends along the upper surface of sole structure 30.

The materials forming layers 14 and 15 may vary in different areas of upper 20, and only one or more of layers 14 and 15 may be present in some areas of upper 20. With respect to the areas of lateral side 21 and medial side 22 that extend through forefoot region 11 and midfoot region 12, for example, suitable materials for exterior layer 14 are various textiles, woven and/or non-woven, leather, synthetic leather, or a single layer mesh, for example, and interior layer 15 may be formed from similar materials. The materials that form tongue 23 and the area around ankle opening 26 may be different than the materials discussed above. For example, exterior layer 14 may be formed from a material that includes two spaced textile layers interconnected by a plurality of connecting fibers. One or both of the textile layers may be a mesh material to enhance the air-permeability of upper 20 in this area. In addition, a foam material may be interposed between exterior layer 14 and interior layer 15.

Figure 5:
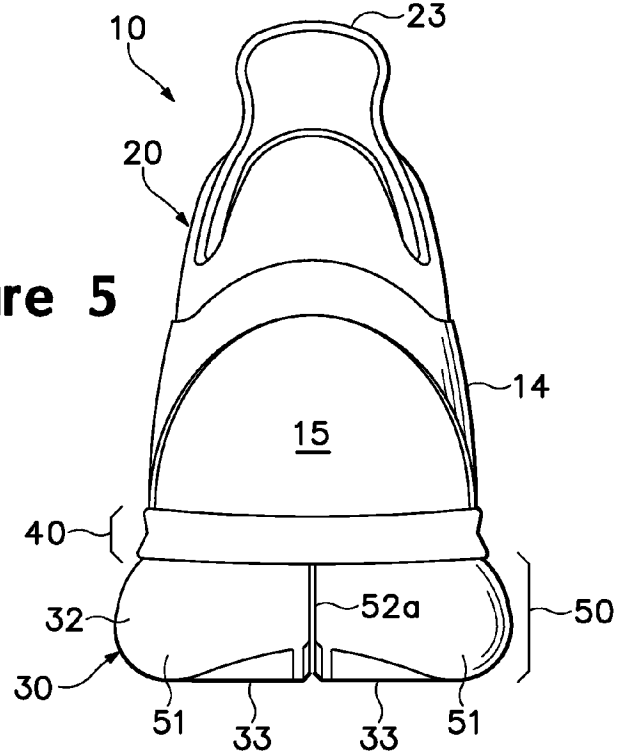
FIG. 5 is a rear elevational view of the first article of footwear.

Whereas the areas discussed above are formed from both layers 14 and 15, a portion of upper 20 may only include a single layer. Referring to FIGS. 4B and 5, the area of upper 20 located within heel region 13 and extending around the rear portion of heel region 13 is formed solely from interior layer 15. That is, exterior layer 14 is absent in this portion of heel region 13 such that interior layer 15 forms both the exterior and interior of upper 20. In some embodiments of the invention, however, the portion of upper 20 in heel region 13 may incorporate a conventional heel counter formed of a semi-rigid polymer material, for example, to ensure that the heel remains properly positioned with respect to upper 20. The heel counter may be located on an exterior of upper 20 or within the various material elements forming upper 20. As will be discussed below, however, the configuration of upper 20 and sole structure 30 does not necessitate the presence of a heel counter.

Based upon the above discussion, the various portions of upper 20 include different combinations of materials that form layers 14 and 15. For example, the materials forming exterior layer 14 and interior layer 15 in the areas of tongue 23 and around ankle opening 26 may be different than the materials forming exterior layer 14 and interior layer 15 in the areas of lateral side 21 and medial side 22 that extend through forefoot region 11 and midfoot region 12. As depicted in the Figures, however, the material forming interior layer 15 is the same throughout both of these areas, and the same material extends around the rearmost portion of heel region 13. Accordingly, the same material may form a substantial portion of the interior surface of upper 20. In further embodiments, however, different materials may be utilized for the various areas of interior layer 15, or upper 20 may include more than two layers of material.

Exterior layer 14 includes a plurality of incisions 27*a* and 27*b* that expose underlying portions of interior layer 15. By exposing interior layer 15, the stretch properties of upper 20 are selectively modified. In areas where no incisions 27*a* and 27*b* are present, each of layers 14 and 15 contribute to the stretch-resistance of upper 20. In areas where incisions 27*a* and 27*b* are present, however, incisions 27*a* and 27*b* permit exterior layer 14 to stretch to a greater degree. Accordingly, incisions 27*a* and 27*b* are formed in upper 20 to selectively vary the degree of stretch in specific portions of upper 20. In addition, incisions 27*a* and 27*b* may be utilized to vary the air-permeability, flexibility, and overall aesthetics (e.g., color) of upper 20.

Figure 3:
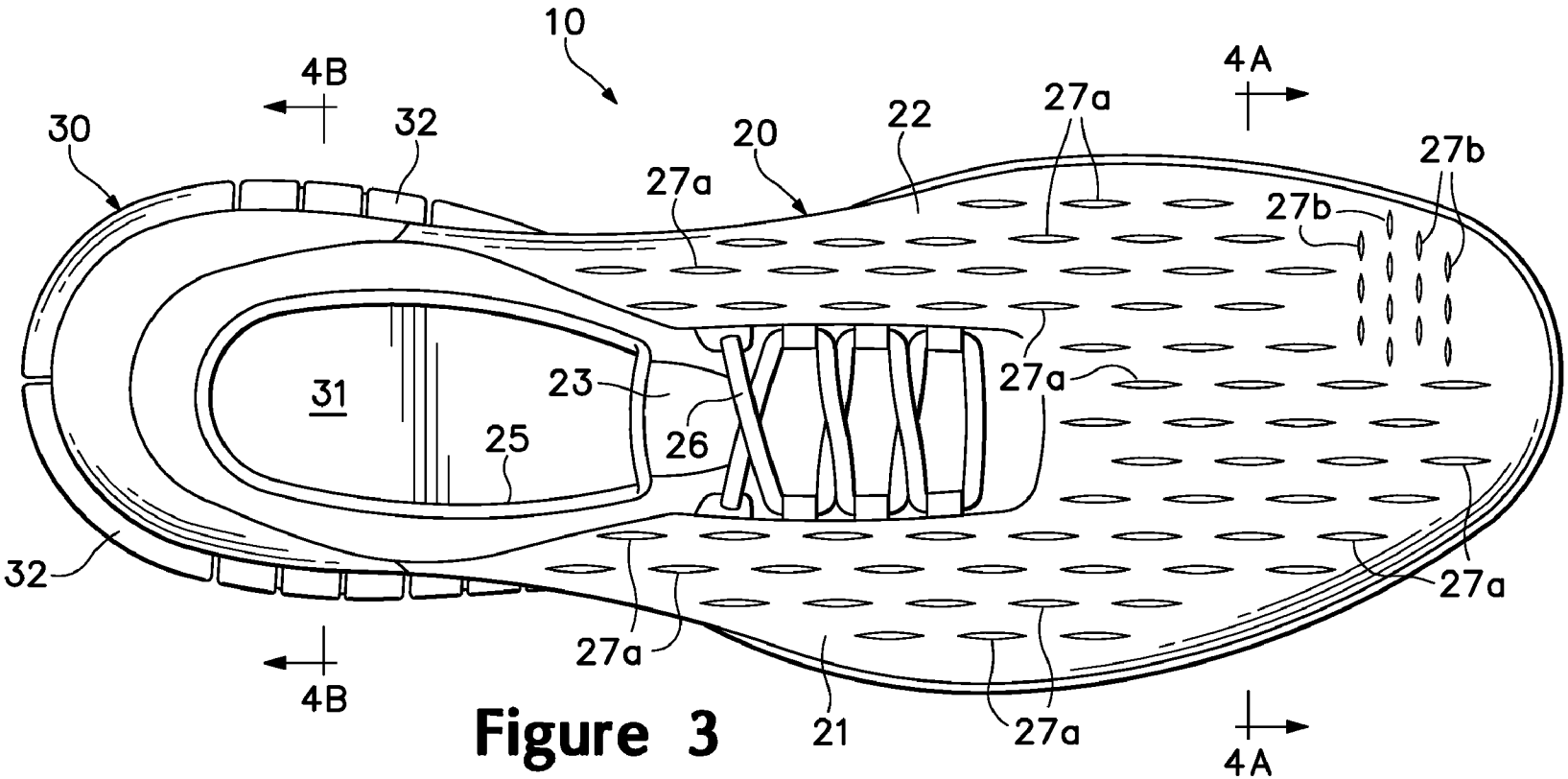
FIG. 3 is a top plan view of the first article of footwear.

With reference to FIGS. 1-3, incisions 27*a* and 27*b* are depicted as being distributed over the areas of lateral side 21 and medial side 22 that extend through forefoot region 11 and midfoot region 12. In general, incisions 27*a* have a linear configuration and are oriented to extend longitudinally with respect to footwear 10. That is, incisions 27*a* are oriented in a direction that extends between forefoot region 11 and heel region 13. In an area of forefoot region 11 that corresponds with the hallux (i.e., the big toe), however, incisions 27*b* are oriented to extend laterally.

The orientation of incisions 27*a* and 27*b* has an effect upon the directions of stretch imparted by incisions 27*a* and 27*b*. In general, incisions 27*a* and 27*b* do not increase the stretch in a direction that corresponds with the linear orientation of incisions 27*a* and 27*b*. That is, a particular incision 27*a* and 27*b* does not increase the stretch in a direction that is parallel to that incision 27. Incisions 27*a* and 27*b* do, however, increase the stretch of upper 20 in a direction that is perpendicular to the linear orientation of incisions 27*a* and 27*b*.

Incisions 27*a* are depicted as forming lines of slits that extend longitudinally, and the incisions 27*a* in adjacent lines are offset from each other. Similarly, incisions 27*b* are depicted as forming lines of slits that extend laterally, and the incisions 27*b* in adjacent lines are offset from each other. The various incisions 27*a* and 27*b*, however, may be added to upper 20 in other arrangements. For example, incisions 27*a* and 27*b* may be offset so as to not form lines, or incisions 27*a* and 27*b* may be randomly placed with respect to upper 20.

Figure 6:
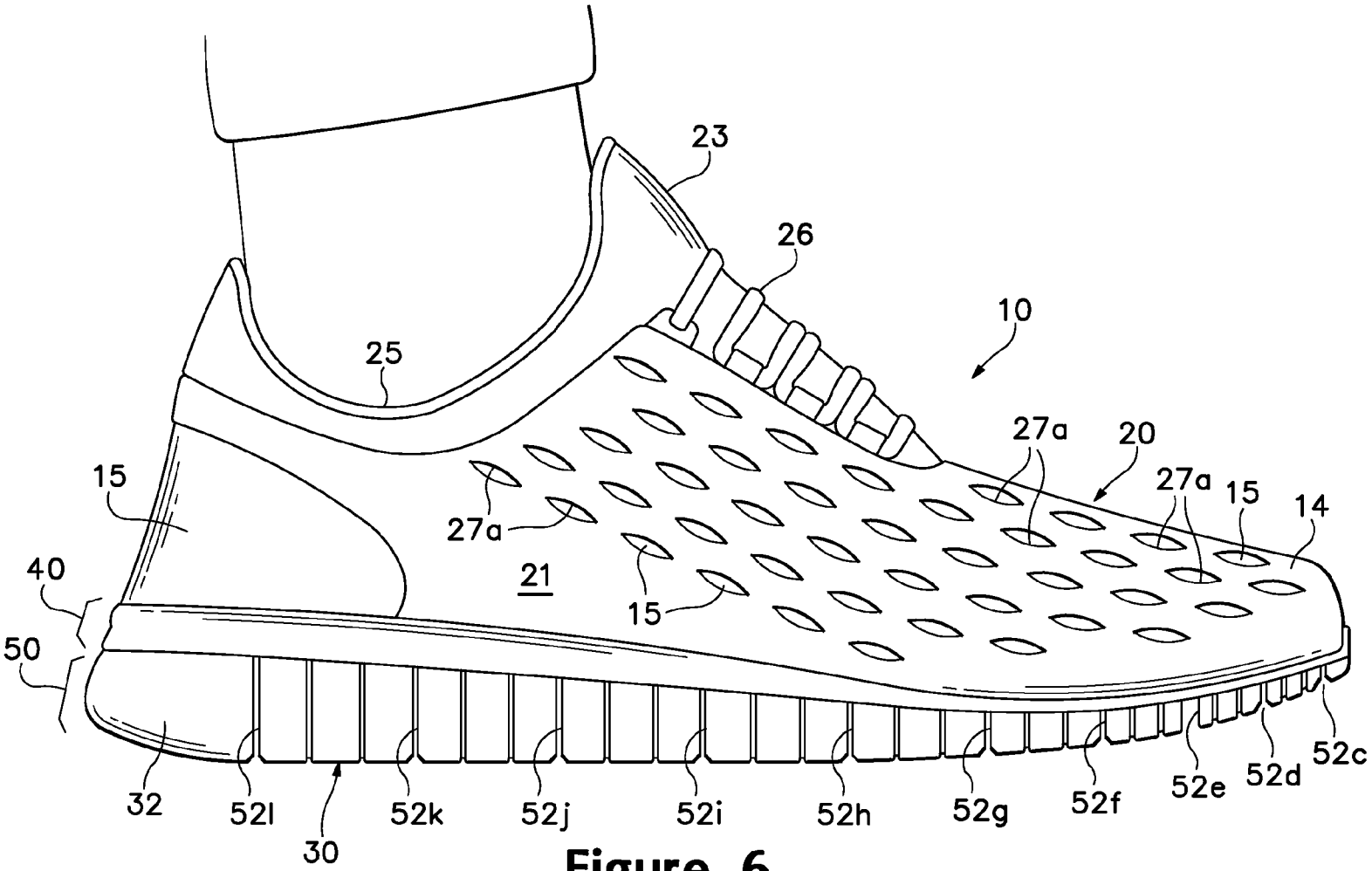
FIG. 6 is a lateral elevational view that illustrates the first article of footwear when receiving a foot.

Incisions 27*a*, as discussed above, are oriented longitudinally with respect to footwear 10. When a foot is placed within upper 20, as depicted in FIG. 6, and exerts a stretching force upon upper 20, and particularly upon exterior layer 14, incisions 27*a* permit upper 20 to stretch in a manner that increases the girth of upper 20. That is, incisions 27*a* stretch in a direction that is perpendicular to the longitudinal orientation of incisions 27*a*. Incisions 27*b* stretch in a similar manner. As discussed above, however, incisions 27*b* are oriented laterally. Accordingly, incisions 27*b* stretch in the longitudinal direction.

Incisions 27*a* and 27*b* are depicted as being linear cuts in exterior layer 14. When a stretching force is exerted upon exterior layer 14 and in a direction that is generally perpendicular to one or more of incisions 27*a* and 27*b*, edges of the incisions 27*a* and 27*b* separate and form a generally elliptical shape with pointed ends, as depicted in FIG. 6. Incisions 27*a* and 27*b* are depicted as having a relatively linear and short configuration. Within the scope of the present invention, however, incisions 27*a* and 27*b* may exhibit a straight or curved configuration, for example, and the length of the various incisions 27*a* and 27*b* may be modified. Differences in the shape and length of incisions 27*a* and 27*b* may be utilized, for example, to modify the desired degree of stretch in upper 20, the air permeability of upper 20, and the flexibility and overall aesthetics of upper 20. Factors that may also be considered when determining the shape and length of incisions 27*a* and 27*b* include the materials utilized within upper 20, the degree of inherent stretch in the materials, and the directions in which stretch is desired, for example.

The materials forming a conventional upper are often stitched or otherwise sewn to each other, and an adhesive bond may be utilized to secure coextensive portions of the materials to each other. As with a conventional upper, layers 14 and 15 are arranged in a coextensive manner and may be bonded to each other. In some embodiments, however, layers 14 and 15 may be separate with no bonding. That is, layers 14 and 15 may be positioned adjacent to each other but not secured together except at edges or stress points, for example, so that interior layer 15 is unsecured to the exterior layer 14 in areas that are proximal to incisions 27*a* and 27*b*. An advantage of this configuration is that exterior layer 14 may stretch and move independent of interior layer 15. That is, incisions 27*a* and 27*b* may permit stretch in exterior layer 14 that is not significantly hindered through an adhesion between layers 14 and 15. In general, therefore, layers 14 and 15 may not be adhered or otherwise secured together in areas that include incisions 27*a* and 27*b*.

Incisions 27*a* and 27*b* are depicted as being formed in exterior layer 14. Within the scope of the present invention, however, incisions 27*a* and 27*b* may also be formed in one or both of layers 14 and 15. For example, incisions 27*a* and 27*b* may be formed in only exterior layer 14, both exterior layer 14 and interior layer 15, or in only interior layer 15. In some embodiments where both of layers 14 and 15 include incisions 27*a* and 27*b*, the incisions 27*a* and 27*b* may aligned or offset. Based upon the preceding discussion, therefore, the configuration of incisions 27*a* and 27*b* may vary considerably within the scope of the present invention.

Incisions 27*a* and 27*b* may be formed through a variety of methods. As an example, incisions 27*a* and 27*b* may be formed with a cutting instrument, such as a die, knife, or razor. In addition to cutting instruments, a laser apparatus may be employed to form incisions 27*a* and 27*b* and cut exterior layer 14 from a larger material element. Incisions 27*a* and 27*b* may be formed, therefore, by directing a laser at exterior layer 14 to remove the portions of exterior layer 14 that correspond with incisions 27*a* and 27*b*. The width of incisions 27*a* and 27*b* may approximately correspond with the width of the laser. Alternately, multiple passes of the laser may be utilized to form incisions 27*a* and 27*b* with a greater width. The laser apparatus may have the capacity to produce a laser beam of variable intensity by adjusting the power of the laser beam. In addition to adjusting the power, the focus of the laser beam and the velocity of the laser beam relative to exterior layer 14 may be varied. An example of a suitable laser apparatus is any of the conventional $CO_2$ or Nd:YAG laser apparatuses, as disclosed in U.S. Pat. Nos. 5,990,444 and 6,140,602 to Costin, which are hereby incorporated by reference.

For materials such as synthetic leather, leather, polymer sheets, and polymer textiles, which are often incorporated into footwear uppers, the power of the laser beam that forms incisions 27*a* and 27*b* is generally in a range of 0.25 to 25 watts, for example. If the laser beam has a relatively narrow focus, the power of the laser beam may be decreased to account for the greater energy per unit area in the laser beam. Similarly, if the laser beam has a relatively wide focus, the power of the laser beam may be increased to account for the lesser energy per unit area in the laser beam. Modifications to the velocity of the laser beam may also be utilized to account for the focus and power of the laser beam. Whereas materials such as leather, synthetic leather, and polymer textiles may require a relatively small power to form incisions 27*a* and 27*b*, other materials such as high-density polymers may require greater power to form incisions 27*a* and 27*b* to the same depth. Accordingly, many factors are considered in determining the proper power, focus, and/or velocity of the laser beam for forming incisions 27*a* and 27*b*.

The laser apparatus may include an emitter for the laser beam that moves adjacent to exterior layer 14 and forms incisions 27*a* and 27*b* in exterior layer 14. That is, the shape of the various incisions 27*a* and 27*b* may be controlled by movements of the laser apparatus relative to exterior layer 14. Alternately, the laser beam may reflect off of one or more movable or pivotable mirrors, and the shape of incisions 27*a* and 27*b* in exterior layer 14 may be controlled by movements of the mirrors.

The laser beam heats selected areas of exterior layer 14 and forms incisions 27*a* and 27*b* by burning or incinerating the selected areas of exterior layer 14. In order to prevent other areas of exterior layer 14 from unintentionally burning, incisions 27*a* and 27*b* may be formed in the presence of a non-combustible fluid, such as carbon dioxide or nitrogen. That is, the laser apparatus may be configured to emit a non-combustible fluid when the laser beam is forming incisions 27*a* and 27*b*.

Once incisions 27*a* and 27*b* are formed in exterior layer 14, the various elements of upper 20 are assembled around a last that imparts the general shape of a foot to the void within upper 20. That is, the various elements are assembled around the last to form lateral side 21 and medial side 22 of upper 20, which extend from forefoot region 11 to heel region 13. In addition, the instep area is formed to include tongue 23 and lace 26, for example, and ankle opening 25 is formed in heel region 13. Lasting sock 24 is also secured to lower edges of lateral side 21 and medial side 22, and lasting sock 24 extends under the last to form a lower surface of the void within upper 20. A portion of sole structure 30 is then permanently secured to a lower area of upper 20, which includes lasting sock 24. In joining upper 20 and sole structure 30, adhesives, stitching, or a combination of adhesives and stitching may be utilized. In this manner, upper 20 is secured to sole structure 30 through a substantially conventional process.

Sole structure 30 includes an insole 31 (depicted in greater detail below), a midsole 32, and an outsole 33. Insole 30 is positioned within upper 20 and adjacent to the upper surface of lasting sock 24 in order to contact the plantar (lower) surface of the foot and enhance the comfort of footwear 10. Midsole 32 is secured to a lower portion of upper 20, including lasting sock 24, and is positioned to extend under the foot during use. Among other purposes, midsole 32 attenuates ground reaction forces when walking or running, for example Suitable materials for midsole 32 are any of the conventional polymer foams that are utilized in footwear midsoles, including ethylvinylacetate and polyurethane foam. Midsole 32 may also be formed from a relatively lightweight polyurethane foam having a specific gravity of approximately 0.22, as manufactured by Bayer AG under the BAYFLEX trademark. Outsole 33 is secured to a lower surface of midsole 32 to provide wear-resistance, and outsole 33 may be recessed within midsole 32. Although outsole 33 may extend throughout the lower surface of midsole 32, outsole 33 is located within heel portion 13 in the particular embodiment depicted in the figures. Suitable materials for outsole 33 include any of the conventional rubber materials that are utilized in footwear outsoles, such as carbon black rubber compound.

A conventional footwear midsole is a unitary, polymer foam structure that extends throughout the length of the foot and may have a stiffness or inflexibility that inhibits the natural motion of the foot. In contrast with the conventional footwear midsole, midsole 32 has an articulated structure that imparts relatively high flexibility and articulation. The flexible structure of midsole 32 (in combination with the structure of upper 20) is configured to complement the natural motion of the foot during running or other activities, and may impart a feeling or sensation of barefoot running. In contrast with barefoot running, however, midsole 32 attenuates ground reaction forces and decreases the overall stress upon the foot.

Midsole 32 includes a connecting portion 40 and a siped portion 50. Connecting portion 40 forms an upper surface 41 and an opposite lower surface 42. Upper surface 41 is positioned adjacent to upper 20 and may be secured directly to upper 20, thereby providing support for the foot. Upper surface 41 may, therefore, be contoured to conform to the natural, anatomical shape of the foot. Accordingly, the area of upper surface 41 that is positioned in heel region 13 may have a greater elevation than the area of upper surface 41 in forefoot region 11. In addition, upper surface 41 may form an arch support area in midfoot region 12, and peripheral areas of upper surface 41 may be generally raised to provide a depression for receiving and seating the foot. In further embodiments, upper surface 41 may have a non-contoured configuration.

Figure 9A:
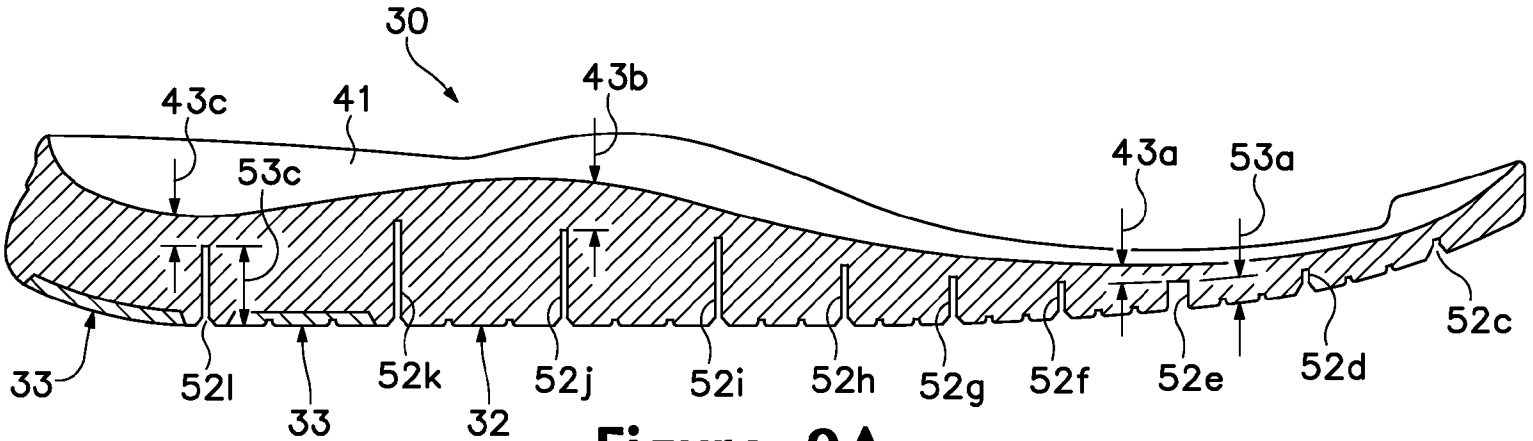
FIG. 9A is a first cross-sectional view of the sole structure of the first article of footwear, as defined by section line 9A-9A in FIG. 8.
Figure 9C:
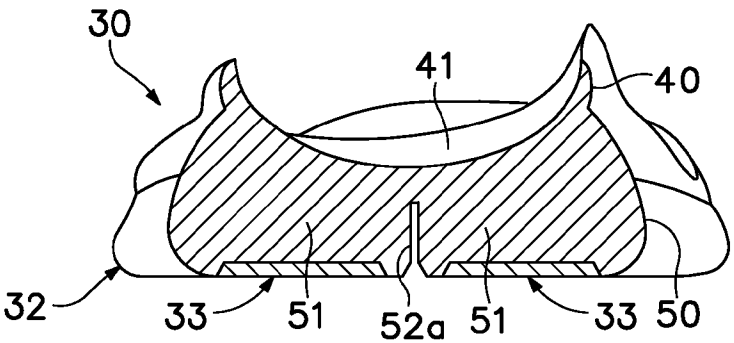
FIG. 9C is a third cross-sectional view of the sole structure of the first article of footwear, as defined by section line 9C-9C in FIG. 8.
Figure 9B:
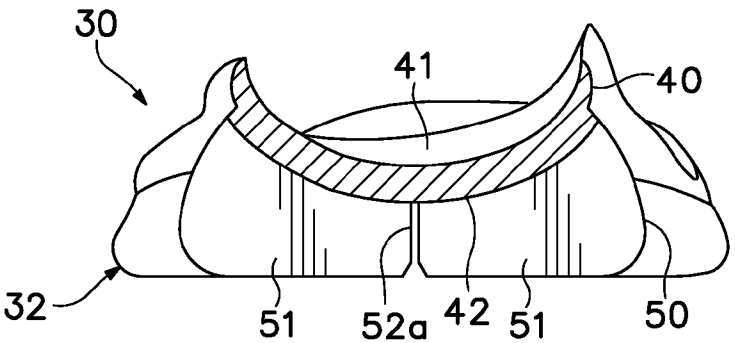
FIG. 9B is a second cross-sectional view of the sole structure of the first article of footwear, as defined by section line 9B-9B in FIG. 8.
Figure 9D:
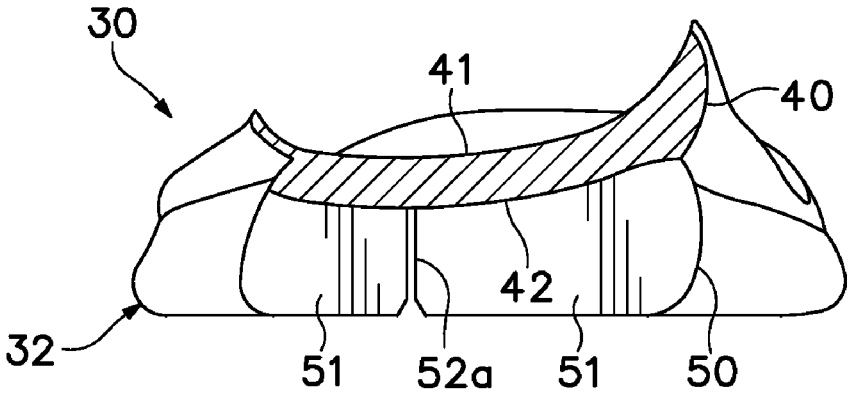
FIG. 9D is a fourth cross-sectional view of the sole structure of the first article of footwear, as defined by section line 9D-9D in FIG. 8.
Figure 9E:
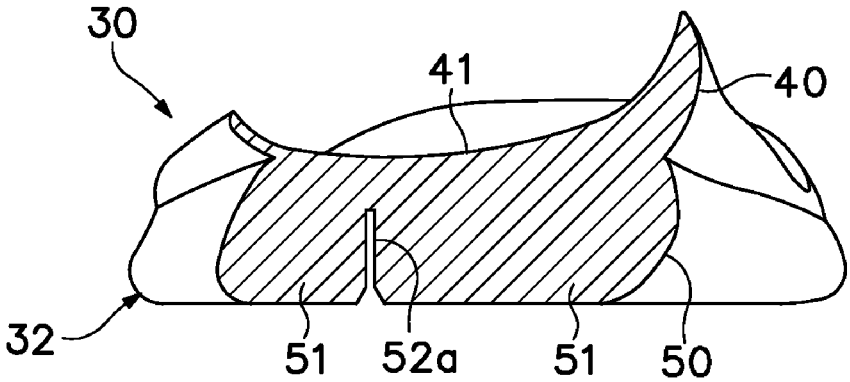
FIG. 9E is a fifth cross-sectional view of the sole structure of the first article of footwear, as defined by section line 9E-9E in FIG. 8.
Figure 9F:
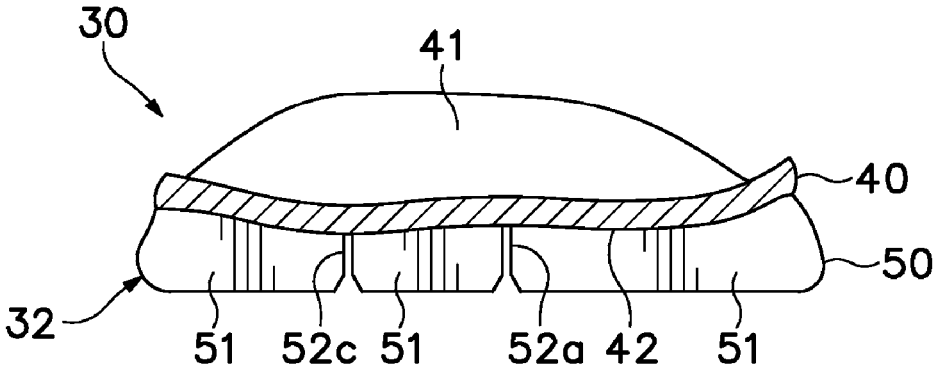
FIG. 9F is a sixth cross-sectional view of the sole structure of the first article of footwear, as defined by section line 9F-9F in FIG. 8.
Figure 9G:
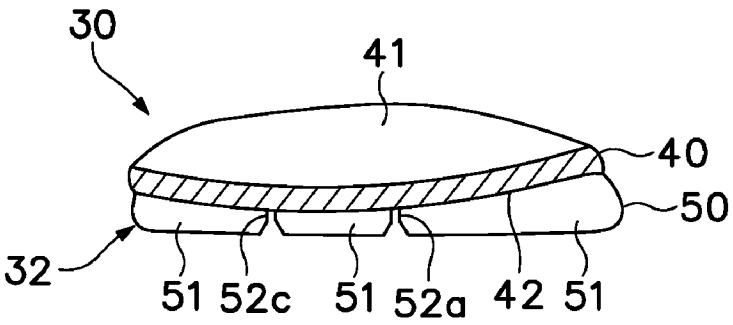
FIG. 9G is a seventh cross-sectional view of the sole structure of the first article of footwear, as defined by section line 9G-9G in FIG. 8.

The thickness of connecting portion 40, which is defined as the dimension that extends between upper surface 41 and lower surface 42, may vary along the longitudinal length of midsole 32. The thickness is depicted graphically in FIG. 9A as thickness dimensions 43*a*-43*c*. Dimension 43*a*, defined in forefoot region 11, may be approximately 3 millimeters and may range from 1 to 5 millimeters, for example. Dimension 43*b*, defined in midfoot region 12, may be approximately 8 millimeters and may range from 1 to 11 millimeters, for example. Similarly, dimension 43*c*, defined in heel region 13, may be approximately 6 millimeters and may range from 1 to 10 millimeters, for example. The thickness of connecting portion 40 may, therefore, increase in directions that extend from forefoot region 11 and heel region 13 toward midfoot region 12. A variety of thickness dimensions and variations will be suitable for connecting portion 40.

Areas of connecting portion 40 that exhibit a relatively thin thickness will, in general, possess more flexibility than areas of connecting portion 40 that exhibit a greater thickness. Variations in the thickness of connecting portion 40 may, therefore, be utilized to modify the flexibility of sole structure 30 in specific areas. For example, forefoot region 11 may be configured to have relatively high flexibility by forming connecting portion 40 with a lesser thickness. A relatively low flexibility may be imparted to midfoot region 12 by forming connecting portion 40 with a greater thickness. Similarly, an intermediate flexibility may be imparted to heel region 13 by forming connecting portion 40 with a thickness that is between the thicknesses of forefoot region 11 and midfoot region 12.

Figure 8:
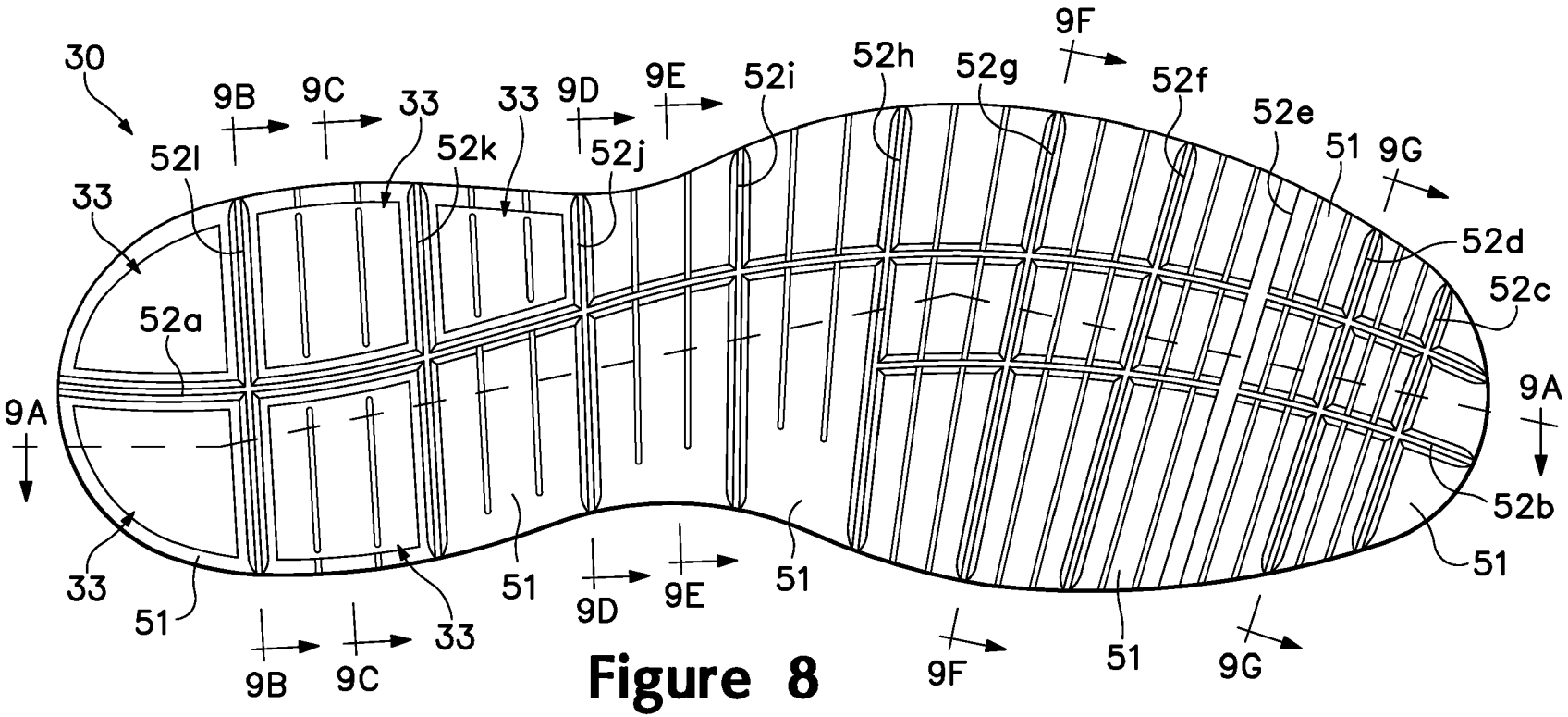
FIG. 8 is a bottom plan view of a sole structure of the first article of footwear.

Siped portion 50 forms a plurality of individual, separate sole elements 51 that are separated by a plurality of sipes 52*a*-52*l*. Sole elements 51 are discrete portions of midsole 30 that extend downward from connecting portion 40. In addition, sole elements 51 are secured to connecting portion 40 and may be formed integral with connecting portion 40. The shape of each sole element 51 is determined by the positions of the various sipes 52*a*-52*l*. As depicted in FIG. 8, sipes 52*a* and 52*b* extend in a longitudinal direction along sole structure 30, and sipes 52*c*-52*l* extend in a generally lateral direction. This positioning of sipes 52*a*-52*l* forms a majority of sole elements 51 to exhibit a generally square, rectangular, or trapezoidal shape. The rearmost sole elements 51 may have a quarter-circular shape due to the curvature of sole structure 30 in heel region 13.

The thickness of siped portion 50, which is defined as the dimension that extends between lower surface 40 to a lower surface of midsole 32, may vary along the longitudinal length of midsole 32. The thickness is depicted graphically in FIG. 9A as thickness dimensions 53*a* and 53*c*. Dimension 53*a*, defined in forefoot region 11, may be approximately 7 millimeters and may range from 3 to 12 millimeters, for example. Similarly, dimension 53*c*, defined in heel region 13, may be approximately 12 millimeters and may range from 8 to 20 millimeters, for example. The thickness of siped portion 50 may, therefore, increase in a direction that extends from forefoot region 11 to heel region 13. One skilled in the relevant art will recognize, however, that a variety of thickness dimensions and variations will be suitable for siped portion 50.

The combination of dimension 43*a* and 53*a* forms the overall thickness of midsole 32 in forefoot region 11. Similarly, the combination of dimensions 43*c* and 53*c* forms the overall thickness of midsole 32 in heel region 13. Although the configuration of footwear 10 is substantially similar for footwear that is intended for males and females, experimental analysis has determined that males generally prefer a lesser overall thickness differential than females. Accordingly, footwear 10 that is designed for males may have an overall thickness in forefoot region 11 that is 10 millimeters and an overall thickness in heel region 13 that is 18 millimeters, thereby providing a differential of 8 millimeters. Footwear 10 that is designed for females, however, may have an overall thickness in forefoot region 11 that is also 10 millimeters and an overall thickness in heel region 13 that is 22 millimeters, thereby providing a differential of 12 millimeters. Footwear 10 that is designed for females may, therefore, exhibit an overall thickness differential between forefoot region 11 and heel region 13 that is greater than the thickness differential for males. The greater thickness differential may be imparted to footwear 10 by increasing the thickness of the sole elements 51 that are located in heel region 13, for example.

The shape of each sole element 51, as discussed above, is determined by the positions of the various sipes 52*a*-52*l*, which are incisions or spaces that extend upward into midsole 32 and extend between sole elements 51. Sipes 52*a*-52*l* also increase the flexibility of sole structure 30 by forming an articulated configuration in midsole 32. Whereas the conventional footwear midsole is a unitary element of polymer foam, sipes 52*a*-52*l* form flexion lines in sole structure 30 and, therefore, have an effect upon the directions of flex in midsole 32. The manner in which sole structure 30 may flex or articulate as a result of sipes 52*a*-52*l* is graphically depicted in FIG. 7.

Lateral flexibility of sole structure 30 (i.e., flexibility in a direction that extends between a lateral side and a medial side) is provided by sipes 52*a* and 52*b*. Sipe 52*a* extends longitudinally through all three of regions 11-13. Although sipe 52*a* may have a straight or linear configuration, sipe 52*a* is depicted as having a generally curved or s-shaped configuration. In forefoot region 11 and midfoot region 12, sipe 52*a* is spaced inward from the lateral side of sole structure 30, and sipe 52*a* is centrally-located in heel region 13. Sipe 52*b*, which is only located in forefoot region 11 and a portion of midfoot region 12, is centrally-located and extends in a direction that is generally parallel to sipe 52*a*. In general, the depth of sipes 52*a* and 52*b* increase as sipes 52*a* and 52*b* extend from forefoot region 11 to heel region 13.

Longitudinal flexibility of sole structure 30 (i.e., flexibility in a direction that extends between regions 11 and 13) is provided by sipes 52*c*-52*l*. Sipes 52*c*-52*f* are positioned in forefoot region 11, sipe 52*g* generally extends along the interface between forefoot region 11 and midfoot region 12, sipes 52*h* and 52*i* are positioned in midfoot region 12, sipe 52*j* generally extends along the interface between midfoot region 12 and heel region 13, and sipes 52*k* and 52*l* are positioned in heel region 13. Referring to FIG. 8, sipes 52*i*-52*l* are generally parallel and extend in a medial-lateral direction. Although sipes 52*c*-52*h* also have a generally parallel configuration and extend in the medial-lateral direction, sipes 52*c*-52*h* are somewhat angled with respect to sipes 52*i*-52*l*.

The positions and orientations of sipes 52*a*-52*l* are selected to complement the natural motion of the foot during the running cycle. In general, the motion of the foot during running proceeds as follows: initially, the heel strikes the ground, followed by the ball of the foot. As the heel leaves the ground, the foot rolls forward so that the toes make contact with the ground, and finally the entire foot leaves the ground to begin another cycle. During the time that the foot is in contact with the ground, the foot typically rolls from the outside or lateral side to the inside or medial side, a process called pronation. That is, normally, the outside of the heel strikes first and the toes on the inside of the foot leave the ground last.

Sipes 52*c*-52*l* ensure that the foot remains in a neutral foot-strike position and complement the neutral forward roll of the foot as it is in contact with the ground. Sipes 52*a* and 52*b* provide lateral flexibility in order to permit the foot to pronate naturally during the running cycle. Similarly, the angled configuration of sipes 52*c*-52*h*, as discussed above, provides additional flexibility that further enhances the natural, motion of the foot.

Figure 7:
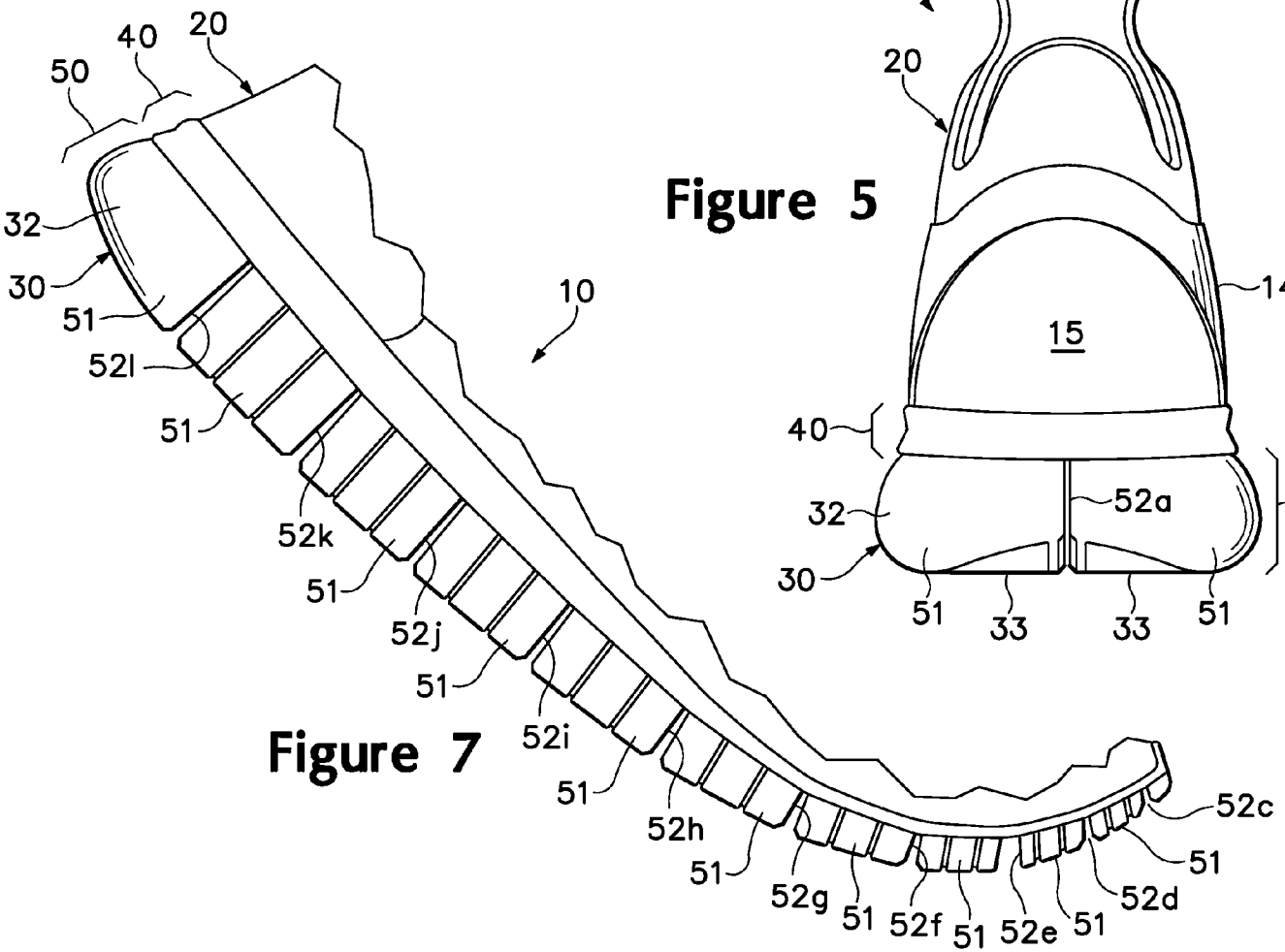
FIG. 7 is a partial lateral elevational view of the first article of footwear in a flexed configuration.
Figure 10A:
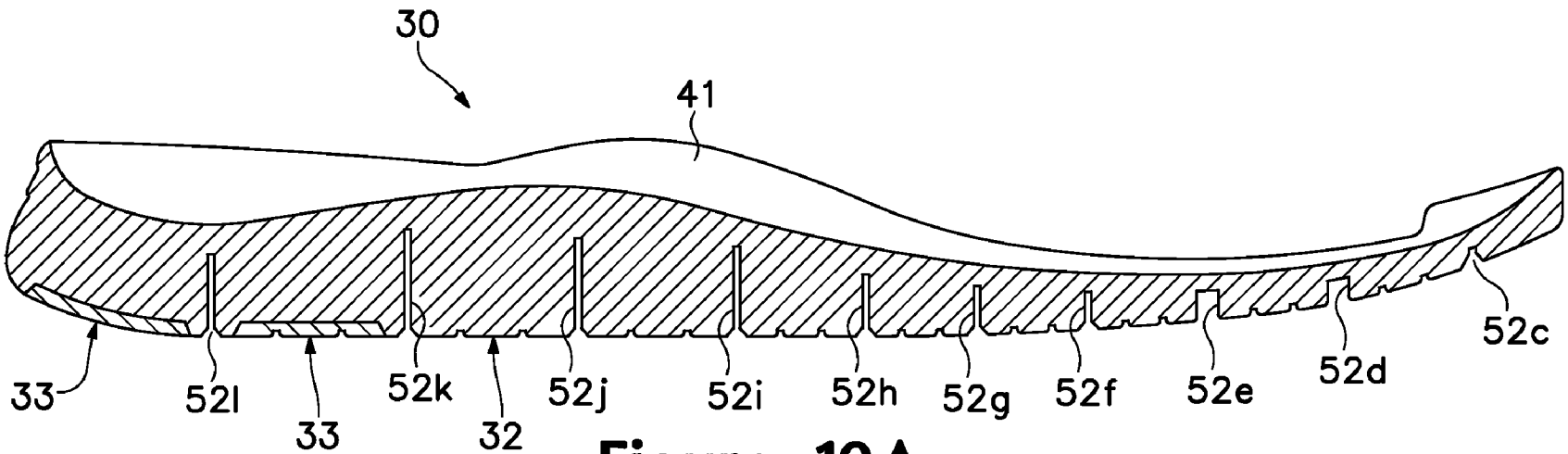
FIG. 10A is a cross-sectional view of an alternate embodiment that corresponds with the location of section line 9A-9A in FIG. 8.

Sipe 52*c* has a width that is greater than the other sipes 52*a*-52*d* and 52*f*-53*l* in order to permit reverse flex in forefoot region 11. In general, sipes 52*a*-52*l* permit upward flexing of sole structure 30, as depicted in FIG. 7. In order to provide further traction at the end of the running cycle (i.e., prior to when the toes leave the ground), an individual may plantar-flex the toes or otherwise press the toes into the ground. The wider aspect to sipe 52*e* facilitates the plantar flexion, thereby encouraging the natural motion of the foot during running. That is, sipe 52*c* forms a reverse flex groove in midsole 32. Experimental analysis has determined that males have a tendency to plantar-flex in the forefoot area to a lesser degree than females. In order to facilitate the greater tendency to plantar flex in females, footwear 10 that is designed for females may include a sipe 52*e* with an even greater width, or sipe 52*d* may also have additional width. Accordingly, each of sipes 52*d* and 52*e* may have increased width in footwear 10 that is designed for females, as depicted in the cross-section of FIG. 10A.

Outsole 33 includes a plurality of outsole elements that are secured to a lower surface of selected sole elements 51, and an indentation is formed in the lower surface of the selected sole elements 51 to receive the outsole elements. As depicted in the figures, outsole 33 is limited to heel region 13. In some embodiments, however, each sole element 51 may be associated with an outsole element, or outsole 33 may extend throughout the lower surface of midsole 32.

A plurality of manufacturing methods are suitable for forming midsole 32. For example, midsole 32 may be formed as a unitary element, with sipes 52*a*-52*l* being subsequently formed through an incision process. Midsole 32 may also be molded such that sipes 52*a*-52*l* are formed during the molding process. Suitable molding methods for midsole 32 include injection molding, pouring, or compression molding, for example. In each of the molding methods, a blown polymer resin is placed within a mold having the general shape and configuration of midsole 32. The mold includes thin blades that correspond with the positions of sipes 52*a*-52*l*. The polymer resin is placed within the mold and around each of the blades. Upon setting, midsole 32 is removed from the mold, with sipes 52*a*-52*l* being formed during the molding process. The width of sipes 52*a*-52*l* may be controlled through modifications to the blade thicknesses within the mold. Accordingly, the reverse flex properties of sipe 52*e*, for example, may be adjusted through the thickness of the blade that forms sipe 52*e*, and the degree to which the other sipes 52*a*-52*d* and 52*f*-52*l* flex in the reverse direction may be controlled through the thickness of corresponding blades. A suitable width range for the blades that form sipes 52*a*-52*d* and 52*f*-52*l* is 0.2-0.3 millimeters, which provides a relatively small degree of reverse flex. Similarly, a suitable width range for the portion of the mold that forms sipe 52*e* is 3-5 millimeters, for example, which provides a greater degree of reverse flex.

Upper 20 and sole structure 30 have a structure that cooperatively flex, stretch, or otherwise move to provide an individual with a sensation of natural, barefoot running. That is, upper 20 and sole structure 30 are configured to complement the natural motion of the foot during running or other activities. As discussed above, exterior layer 14 includes a plurality of incisions 27*a* and 27*b* that enhance the stretch properties of upper 20 in specific areas and in specific directions. Whereas incisions 27*a* may be oriented to permit stretch in the girth of upper 20, for example, incisions 27*b* may facilitate movement of the hallux and plantar-flexion. Incisions 27*a* and 27*b* also provide a generally more flexible structure to upper 20 that complements the flexibility of sole structure 30. As discussed above, midsole 32 includes a plurality of sipes 52*a*-52*l* that enhance the flex properties of sole structure 30. The positions, orientations, and depths of sipes 52*a*-52*l* are selected to provide specific degrees of flexibility in selected areas and directions. That is, sipes 52*a*-52*l* may be utilized to provide the individual with a sensation of natural, barefoot running. In contrast with barefoot running, however, sole structure 30 attenuates ground reaction forces to decrease the overall stress upon the foot.

The conventional sole structure, as discussed above, may have a relatively stiff or inflexible construction that inhibits the natural motion of the foot. For example, the foot may attempt to flex during the stage of the running cycle when the heel leaves the ground. The combination of the inflexible midsole construction and a conventional heel counter operates to resist flex in the foot. In contrast, footwear 10 flexes with the foot, and may have a configuration that does not incorporate a conventional heel counter.

Figure 11:
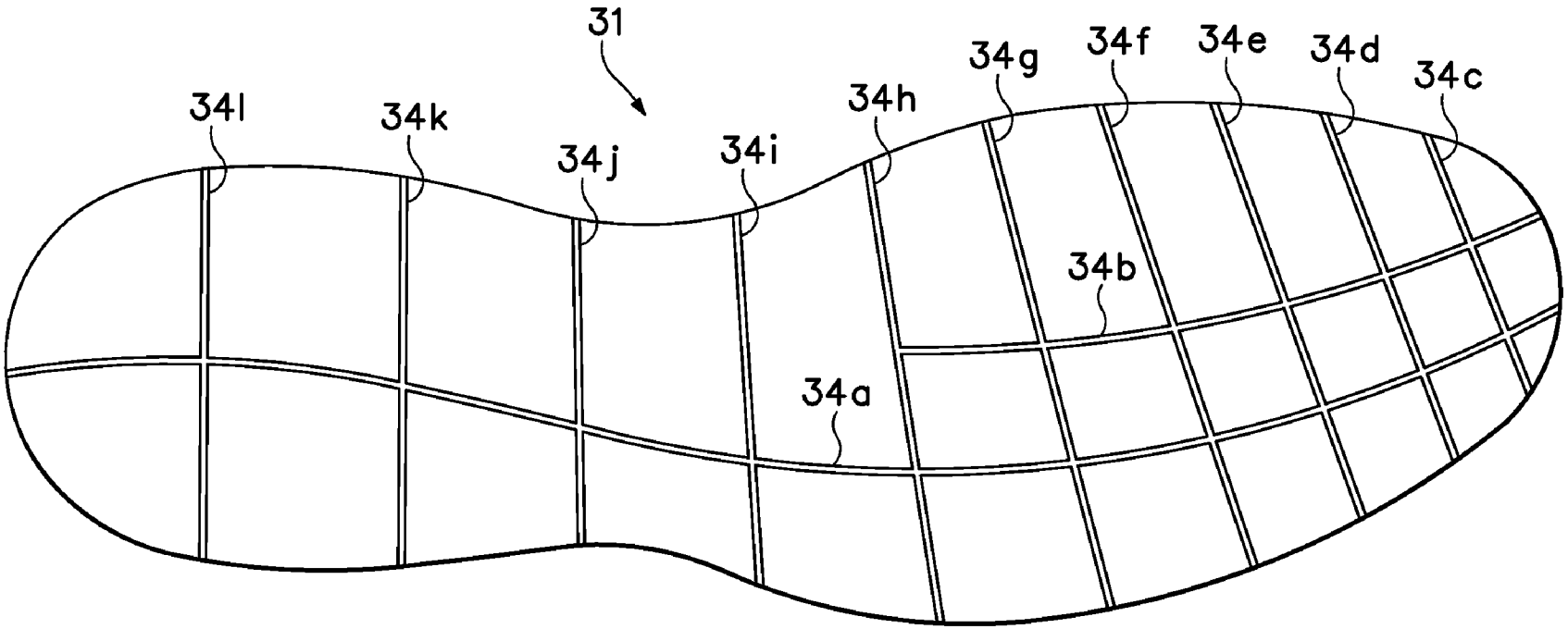
FIG. 11 is a bottom plan view of an insole portion of the first article of footwear.
Figure 12:
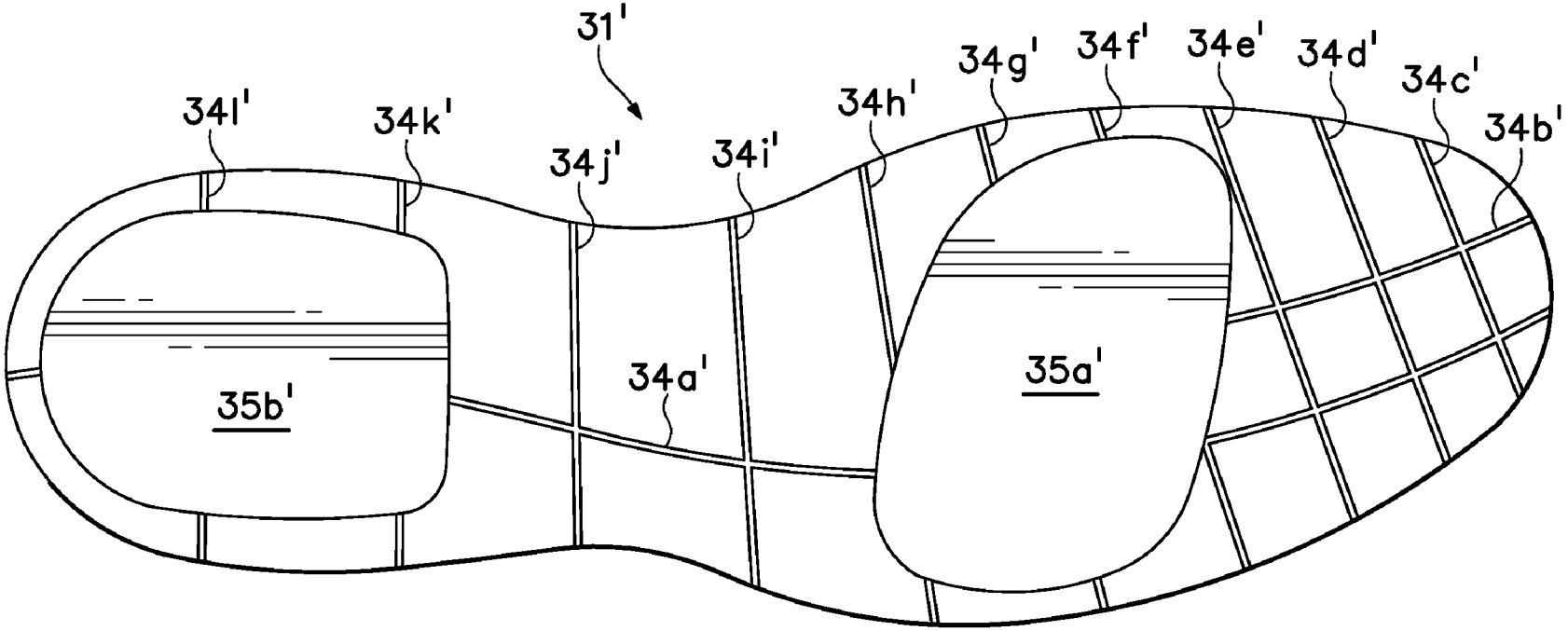
FIG. 12 is a bottom plan view of another insole portion of the first article of footwear.

The overall flexibility of sole structure 30 may be enhanced through the configuration of insole 31. With reference to FIG. 11, a lower surface of insole 31 is depicted as having a plurality of flexion lines 34*a*-34*l* that generally correspond with the positions and configuration of sipes 52*a*-52*l*. More specifically, flexion line 34*a* extends longitudinally through substantially the entire length of insole 31 and generally corresponds with the position of sipe 52*a*. Flexion line 34*b* extends longitudinally through only a portion of the length of insole 31 and generally corresponds with the position of sipe 52*b*. Similarly, flexion lines 34*c*-34*l* extend laterally from a medial side to a lateral side of insole 31 and generally correspond with the positions of sipes 52*c*-52*l*. This configuration provides additional flexibility to sole structure 30 and enhances the articulated configuration imparted by sipes 52*a*-52*l*. A similar configuration is depicted in FIG. 12, wherein an insole 31' includes a plurality of flexion lines 34*a*'-34*l*' and two pads 35*a*' and 35*b*' formed of a compressible polymer foam.

The above discussion details the structure and configuration of footwear 10, as depicted in the figures. Various modifications may be made to footwear 10 without departing from the intended scope of the present invention. For example, incisions 27*a* and 27*b* may be formed in either of layers 14 or 15, or in both of layers 14 and 15. Incisions 27*a* and 27*b* may also be formed in different orientations or positions to provide different stretch characteristics, or a conventional heel counter may be incorporated into upper 20. With respect to sole structure 30, the thickness of connecting portion 40 or the overall thickness of midsole 32 may vary considerably. In addition, the depth, orientation, and positions of sipes 52*a*-52*l* may be modified.

Second Article of Footwear

Figure 13:
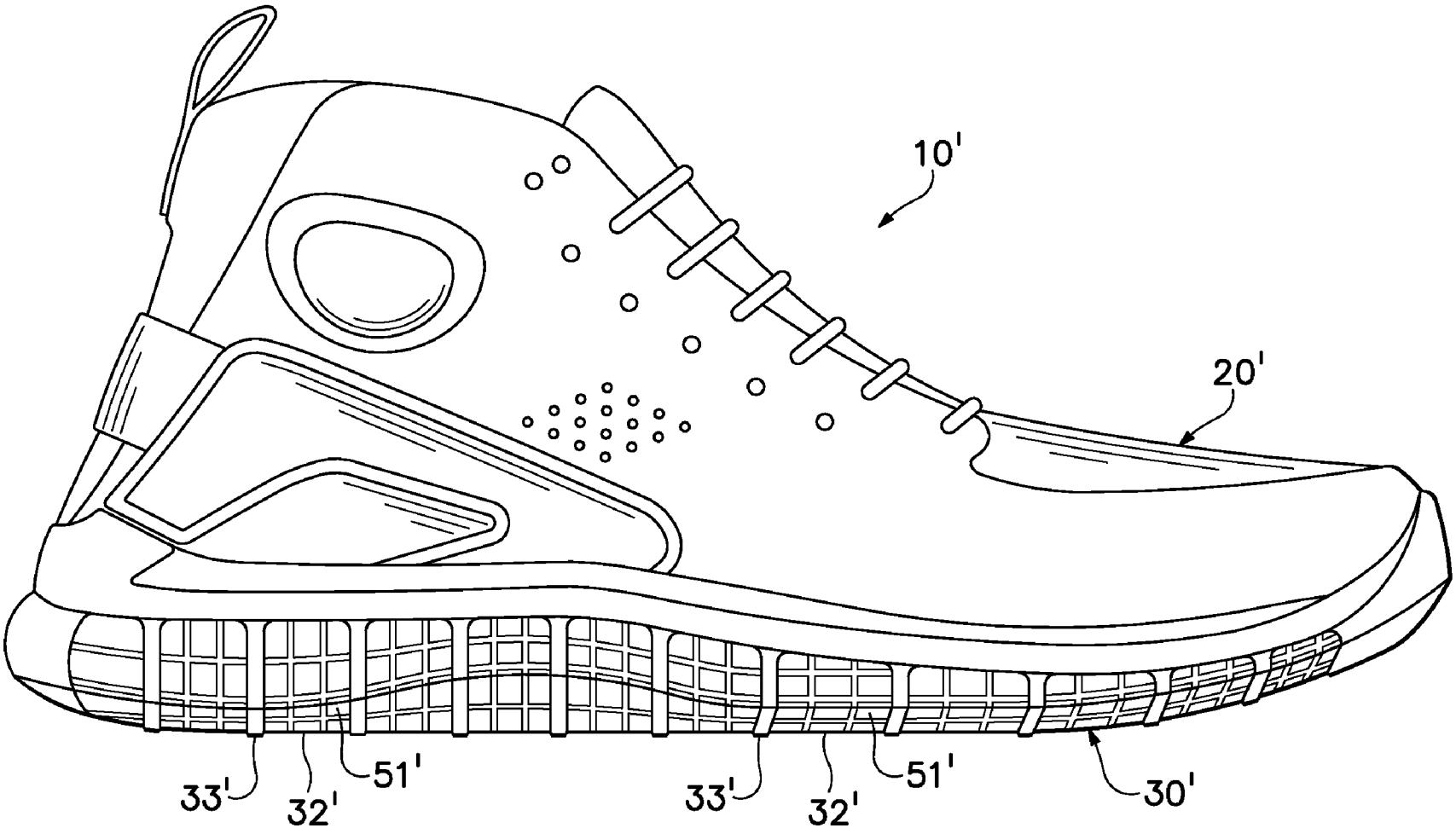
FIG. 13 is a lateral elevational view of a second article of footwear.

Another article of footwear 10' is depicted in FIG. 13 and includes an upper 20' and a sole structure 30'. Upper 20' is formed from various material elements that are stitched or adhesively-bonded together to form an interior void that comfortably receives a foot and secures the position of the foot relative to sole structure 30'. As depicted in FIG. 13, upper 20' has a generally conventional configuration, but may also have a configuration that is substantially similar to upper 20. Sole structure 30' is secured to a lower portion of upper 20' and provides a durable, wear-resistant component for attenuating ground reaction forces as footwear 10' impacts the ground.

Figure 14:
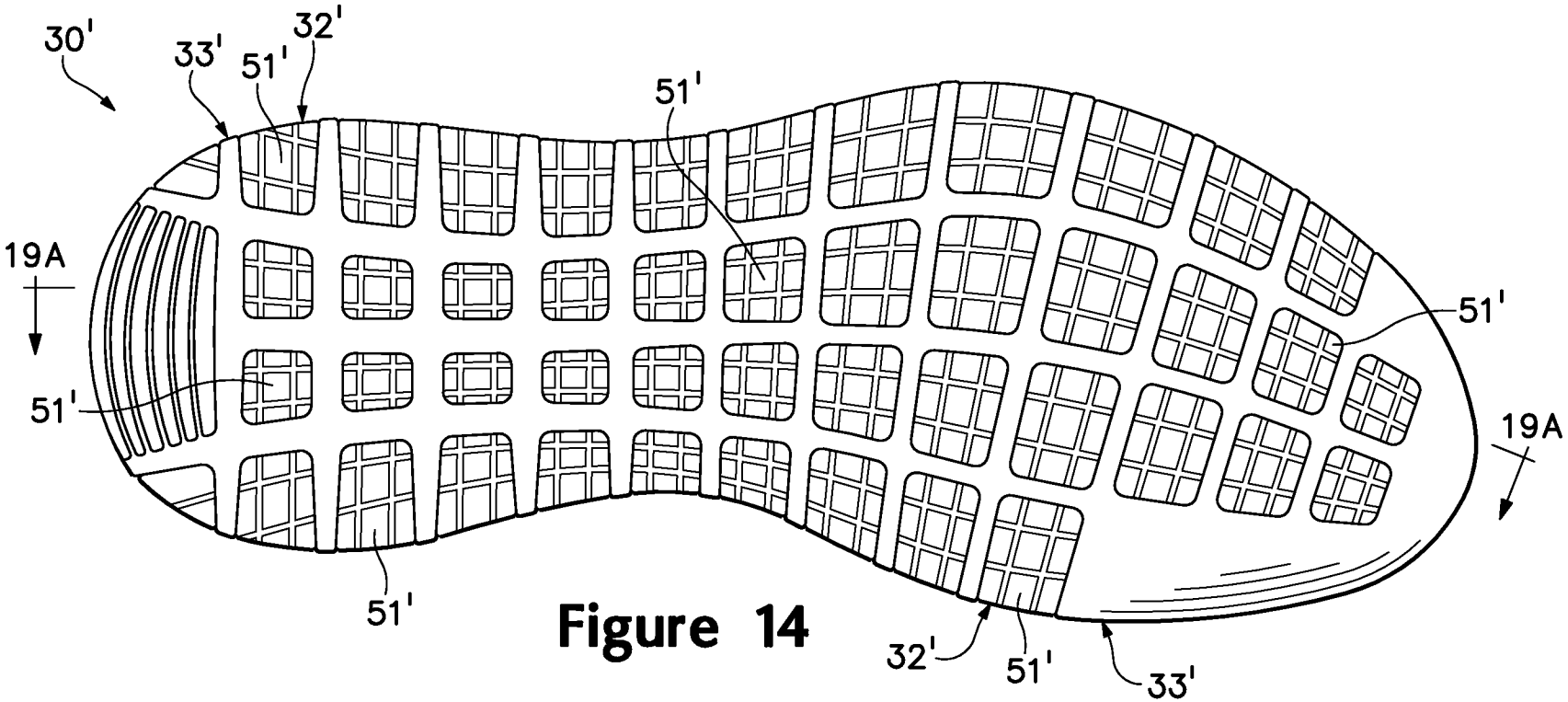
FIG. 14 is a bottom plan view of a sole structure of the second article of footwear.
Figure 17:
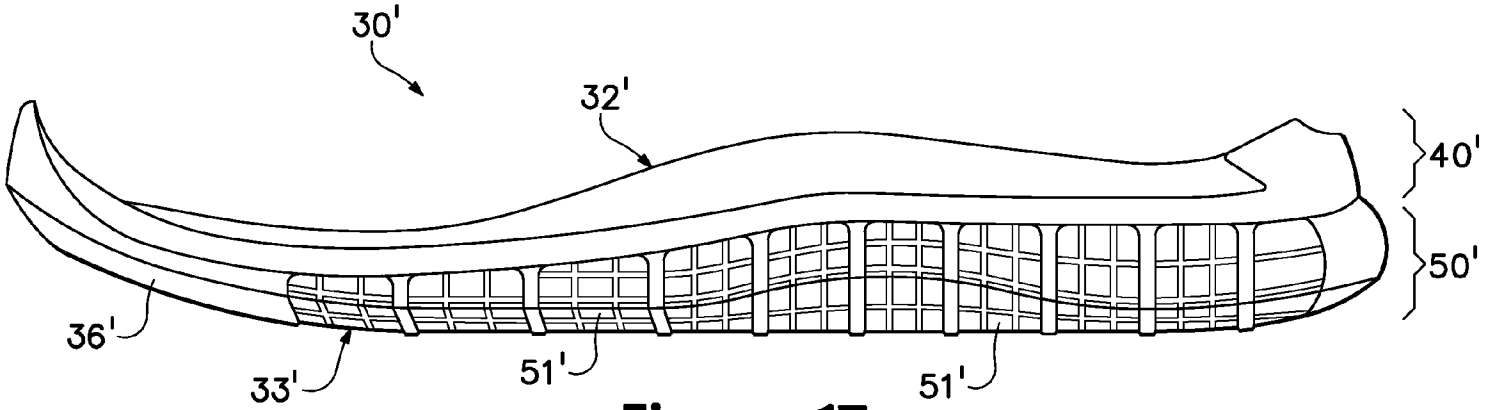
FIG. 17 is a medial elevational view of the sole structure of the second article of footwear.
Figure 18:
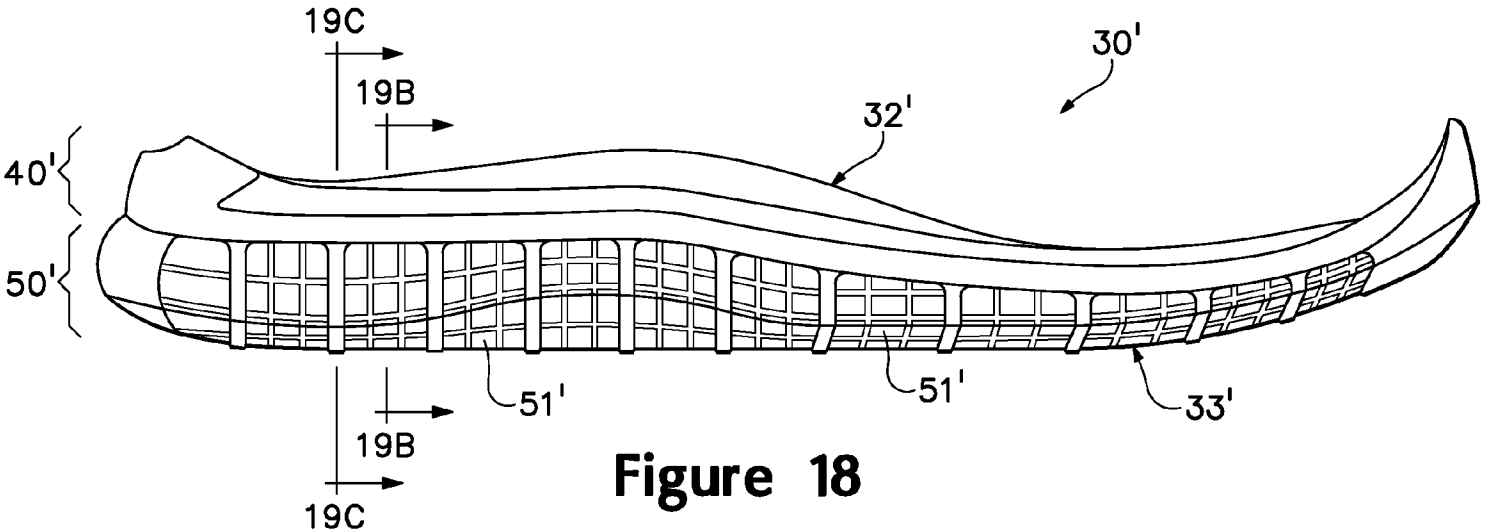
FIG. 18 is a lateral elevational view of the sole structure of the second article of footwear.

Sole structure 30' may include an insole (not depicted) that is substantially similar to insole 31. In addition, sole structure 30' includes a midsole 32' and an outsole 33', as depicted in FIGS. 14, 17, and 18. Midsole 32' is secured to a lower portion of upper 20' and is positioned to extend under the foot during use. Among other purposes, midsole 32' attenuates ground reaction forces when walking or running, for example. Suitable materials for midsole 32' are any of the materials discussed relative to midsole 32. In addition, an ester-based polyurethane manufactured by Rhodia, Incorporated may be utilized for midsole 32'. Outsole 33' is recessed within midsole 32' and extends throughout the length and width of midsole 32'. In other embodiments, outsole 33' may be limited to regions of sole structure 30'. Suitable materials for outsole 33' include any of the conventional rubber materials that are utilized in footwear outsoles, such as carbon black rubber compound. Additional suitable materials for outsole 33' include any of a plurality of injectable polymers, such as thermoplastic polyurethane, for example.

A conventional footwear midsole is a unitary, polymer foam structure that extends throughout the length of the foot and may have a stiffness or inflexibility that inhibits the natural motion of the foot. In contrast with the conventional footwear midsole, midsole 32' has an articulated structure that imparts relatively high flexibility and articulation. The flexible structure of midsole 32' is configured to complement the natural motion of the foot during running or other activities, and may impart a feeling or sensation of barefoot running. In addition, the flexible structure of midsole 32' may assist in strengthening the foot in a manner that is similar to barefoot running. In contrast with barefoot running, however, midsole 32' attenuates ground reaction forces to decrease the overall stress upon the foot.

Figure 19A:
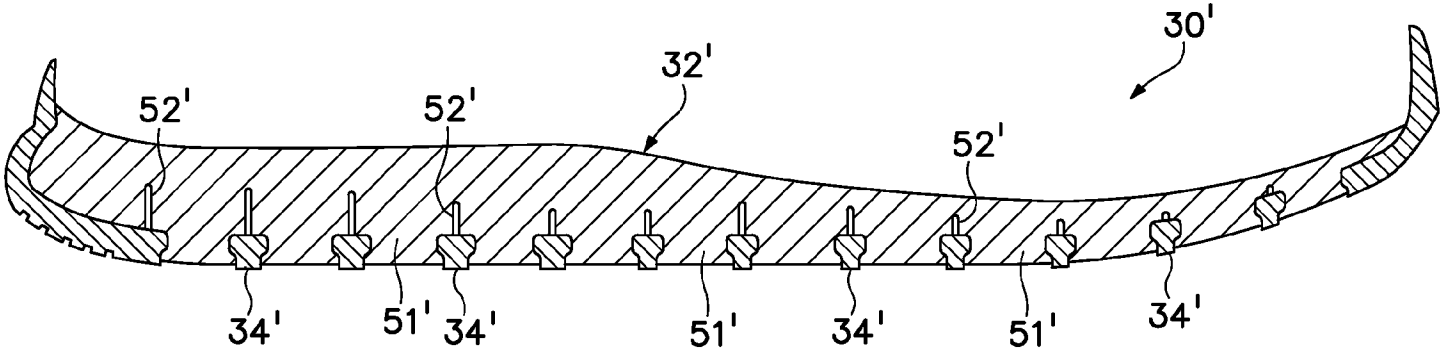
FIG. 19A is a first cross-sectional view of the sole structure of the second article of footwear, as defined by section line 19A-19A in FIG. 14.

Midsole 32' includes a connecting portion 40' and a siped portion 50'. An upper surface of connecting portion 40' is positioned adjacent to upper 20 and may be secured directly to upper 20, thereby providing support for the foot. The upper surface may, therefore, be contoured to conform to the natural, anatomical shape of the foot. The thickness of connecting portion 40', which is defined as a dimension that extends between the upper surface and a lower surface of connecting portion 40', may vary along the longitudinal length of midsole 32'. In general, the thickness of connecting portion 40' may correspond with the dimensions discussed relative to midsole 32. In one example, connecting portion 40' may have a greater thickness in a midfoot region of footwear 10' than in either of the forefoot region or heel region, as depicted in FIG. 19A. Areas of connecting portion 40' that exhibit a relatively thin thickness will, in general, possess more flexibility than areas of connecting portion 40' that exhibit a greater thickness. Variations in the thickness of connecting portion 40' may, therefore, be utilized to modify the flexibility of sole structure 30' in specific areas.

Figure 15:
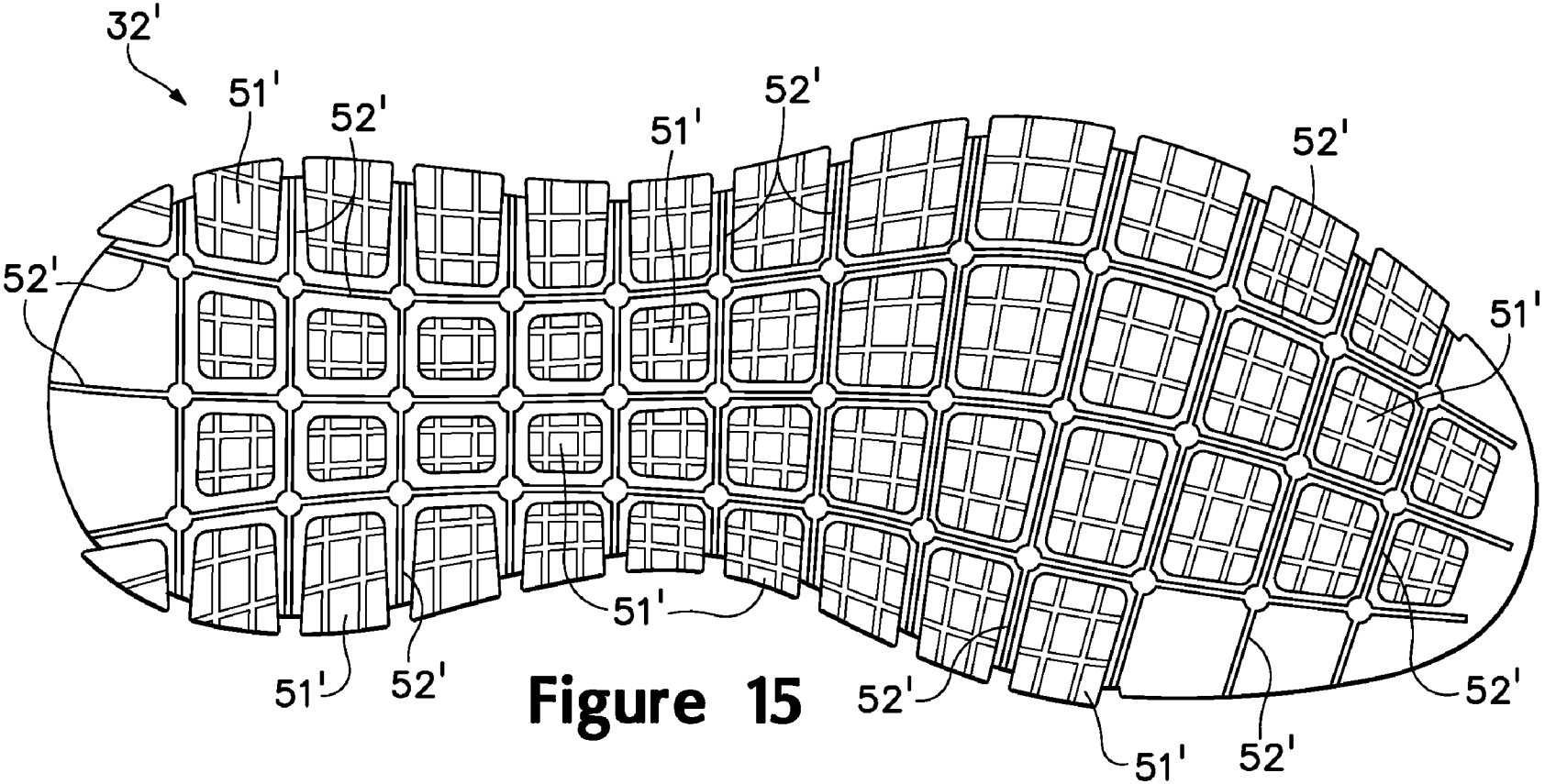
FIG. 15 is a bottom plan view of a first element of the sole structure of the second article of footwear.

Siped portion 50' forms a plurality of individual, separate sole elements 51' that are separated by a plurality of sipes 52'. Sole elements 51' are discrete portions of midsole 30' that extend downward from connecting portion 40'. In addition, sole elements 51' are secured to connecting portion 40' and may be formed integral with connecting portion 40'. The shape of each sole element 51' is determined by the positions of the various sipes 52'. As depicted in FIG. 15, three sipes 52' extend in a longitudinal direction along sole structure 30', and approximately twelve sipes 52' extend in a generally lateral direction. This positioning of sipes 52' forms a majority of sole elements 51' to exhibit a generally square, rectangular, or trapezoidal shape. The rearmost sole element 51 has a curved or quarter-circular shape due to the curvature of sole structure 30' in the heel region of footwear 10'. The thickness of siped portion 50', which is defined as the dimension that extends between the lower surface connecting portion 40' to a lower surface of midsole 32', may vary along the longitudinal length of midsole 32'. In general, the thickness of siped portion 50' may correspond with the dimensions discussed relative to midsole 32.

The shape of each sole element 51', as discussed above, is determined by the positions of the various sipes 52', which are incisions or spaces that extend upward into midsole 32' and extend between sole elements 51'. Sipes 52' also increase the flexibility of sole structure 30' by forming an articulated configuration in midsole 32'. Whereas the conventional footwear midsole is a unitary element of polymer foam, sipes 52' form flexion lines in sole structure 30' and, therefore, have an effect upon the directions of flex in midsole 32'. As with midsole 32, sipes 52' that extend in the longitudinal direction of midsole 32' increase the lateral flexibility of sole structure 30' (i.e., flexibility in a direction that extends between a lateral side and a medial side). Sipes 52' that extend between a lateral side and a medial side of midsole 32' increase the longitudinal flexibility of sole structure 30' (i.e., flexibility in a direction that extends between a forefoot region and heel region).

The positions and orientations of sipes 52' are selected to complement the natural motion of the foot during the running cycle. In general, the motion of the foot during running proceeds as follows: initially, the heel strikes the ground, followed by the ball of the foot. As the heel leaves the ground, the foot rolls forward so that the toes make contact, and finally the entire foot leaves the ground to begin another cycle. During the time that the foot is in contact with the ground, the foot typically rolls from the outside or lateral side to the inside or medial side, a process called pronation. Some sipes 52' ensure that the foot remains in a neutral foot-strike position and complement the neutral forward roll of the foot as it is in contact with the ground. Other sipes 52' provide lateral flexibility in order to permit the foot to pronate naturally during the running cycle.

Figure 16:
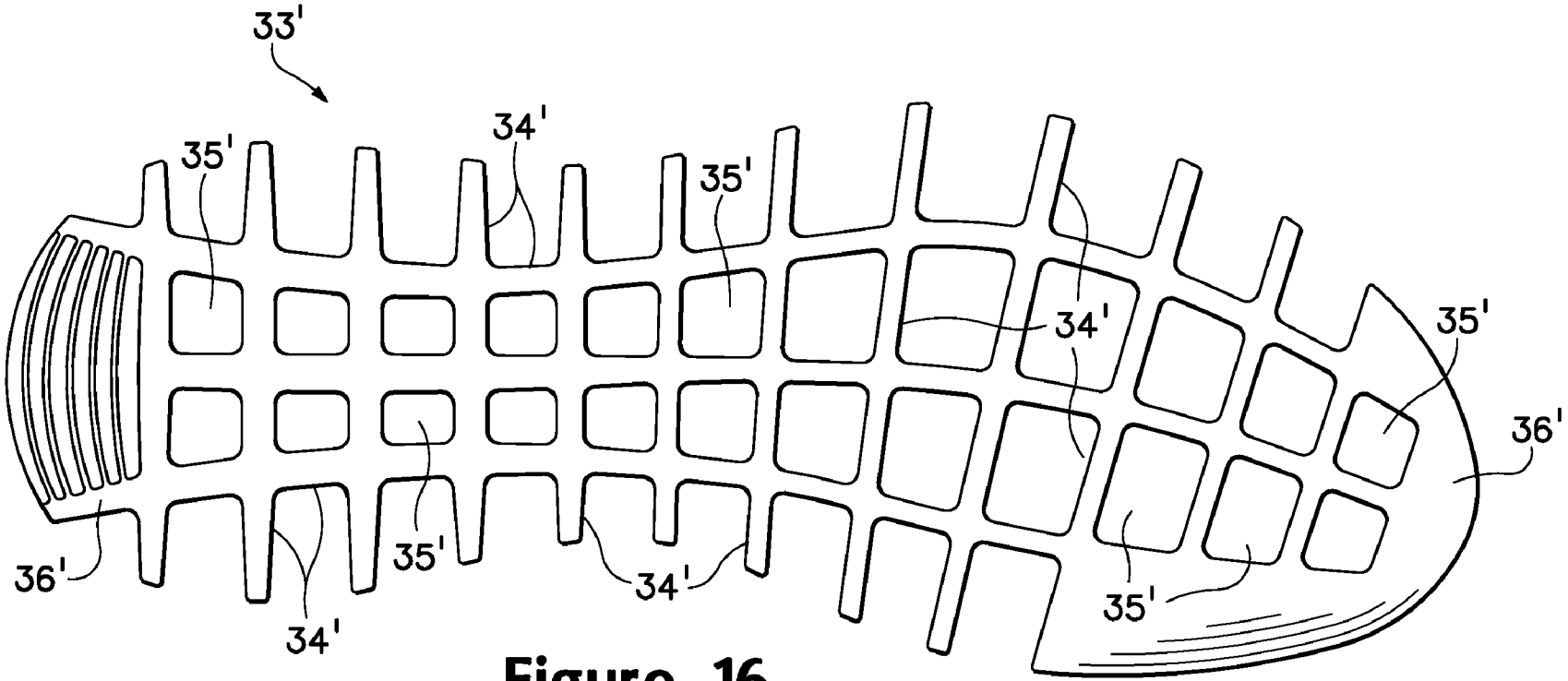
FIG. 16 is a bottom plan view of a second element of the sole structure of the second article of footwear.

Outsole 33' is depicted in FIG. 16 as having a shape that corresponds with the dimensions and relative locations of sipes 52'. When incorporated into sole structure 30', outsole 33' extends into the various sipes 52' and is recessed within midsole 32'. That is, outsole 33' extends between the various sole elements 51' and around the various sole elements 51'. Outsole 33' includes a plurality of segments 34' that are connected to define various apertures 35'. Segments 34' and apertures 35' impart a web-like configuration to outsole 33'. Accordingly, segments 34' extend between the various sole elements 51' and apertures 35' extend around the various sole elements 51'.

Figure 19B:
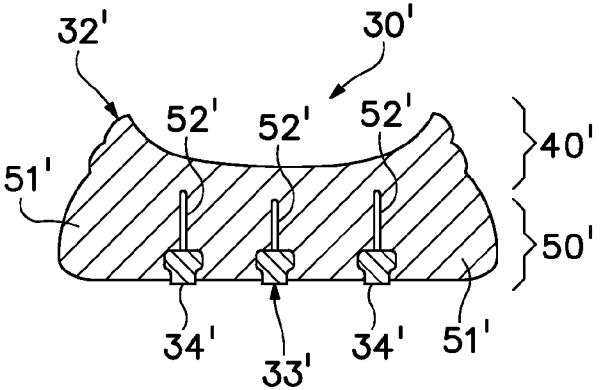
FIG. 19B is a second cross-sectional view of the sole structure of the second article of footwear, as defined by section line 19B-19B in FIG. 18.

Side surfaces of sole elements 51' form indentations, and segments 34' extend into the indentations. In addition, a lower portion of segments 34' extends beyond the lower surface of midsole 32' to form a ground-contacting surface of sole structure 30'. In order to extend into the indentations and extend below the lower surface of midsole 32', segments 34' exhibit a T-shaped configuration in cross-section, as depicted in FIG. 19B. That is, the horizontal segment of the T-shaped configuration extends into the indentations, and the vertical segment of the T-shaped configuration extends below the lower surface of midsole 32'. As discussed above, suitable materials for outsole 33' include any of the conventional rubber materials that are utilized in footwear outsoles, such as carbon black rubber compound. Additional suitable materials for outsole 33' include any of a plurality of injectable polymers, such as thermoplastic polyurethane, for example. Accordingly, outsole 33' provide a durable and wear-resistant surface for sole structure 30'.

The various sipes **52*a*-52*l* of footwear 10 form relatively narrow incisions in midsole 32. At least lower portions of sipes 52' form wider spaces to accommodate segments 34'. That is, the spaces separate at least a portion of sole elements 51', and outsole 33' extends into the spaces. Depending upon the configuration of outsole 33'**, however, the width of the spaces may vary significantly within the scope of the present application.

Figure 19C:
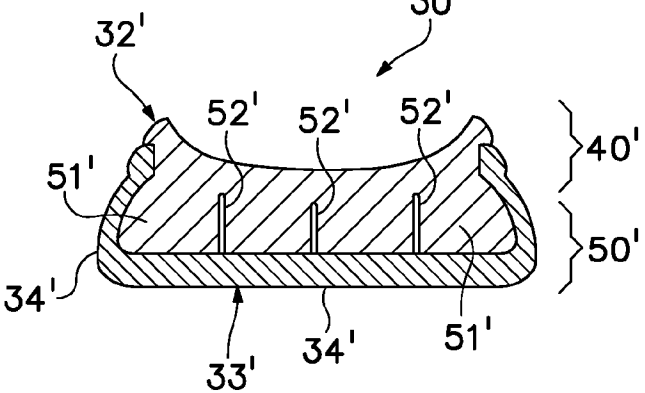
FIG. 19C is a third cross-sectional view of the sole structure of the second article of footwear, as defined by section line 19C-19C in FIG. 18.
Figure 20:
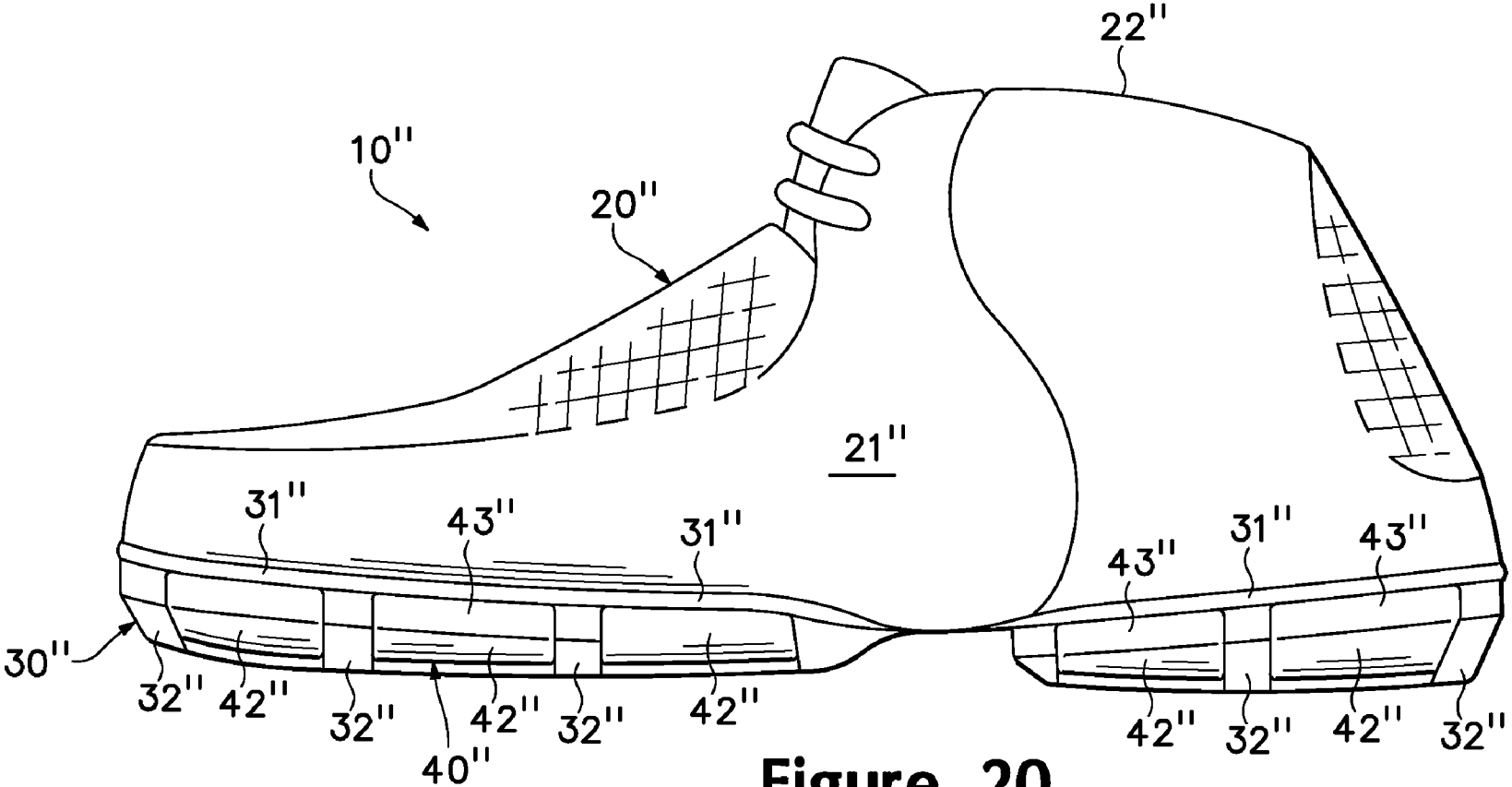
FIG. 20 is a side elevational view of a third article of footwear.
Figure 21:
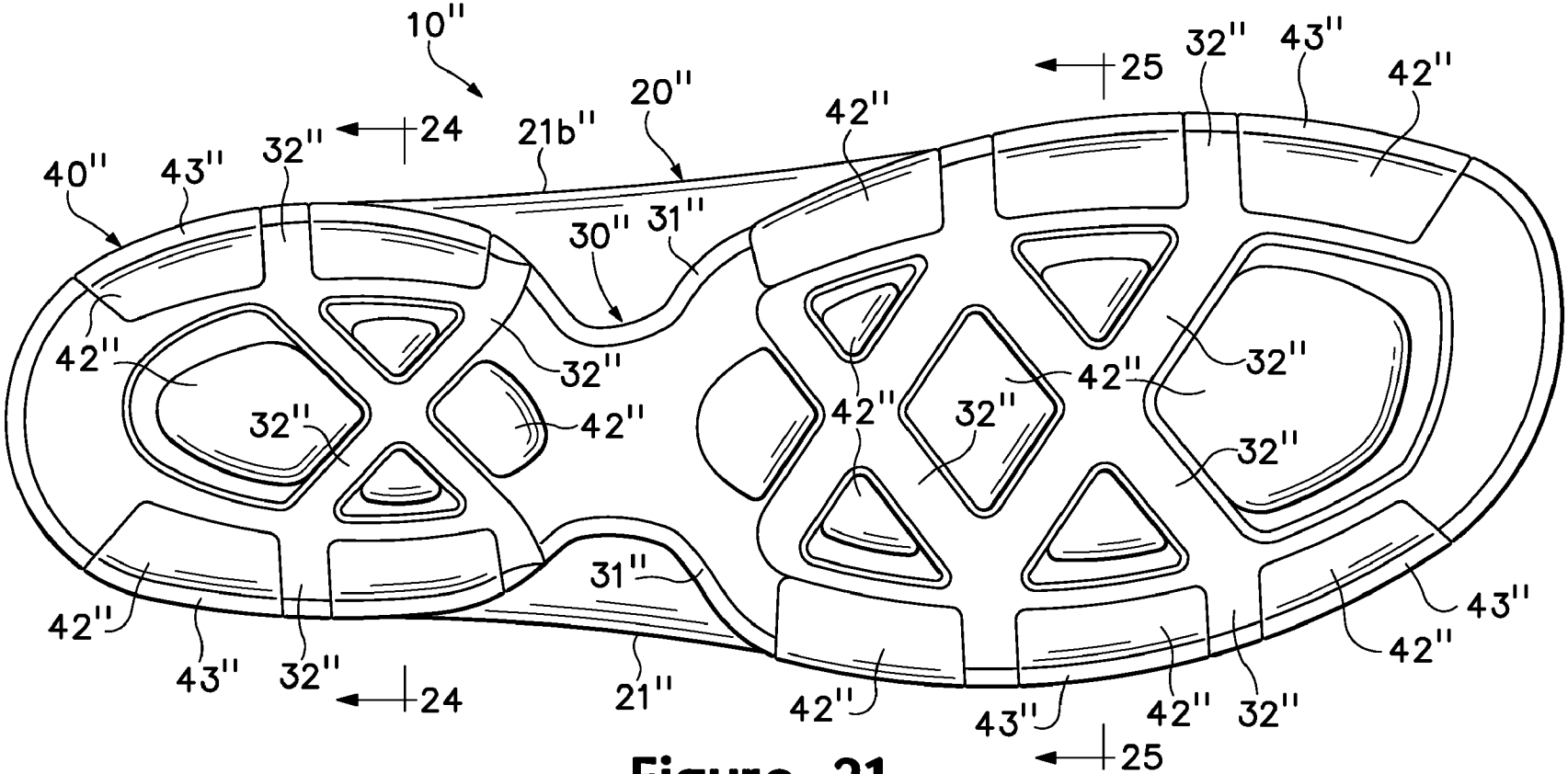
FIG. 21 is a bottom plan view of the third article of footwear.
Figure 22:
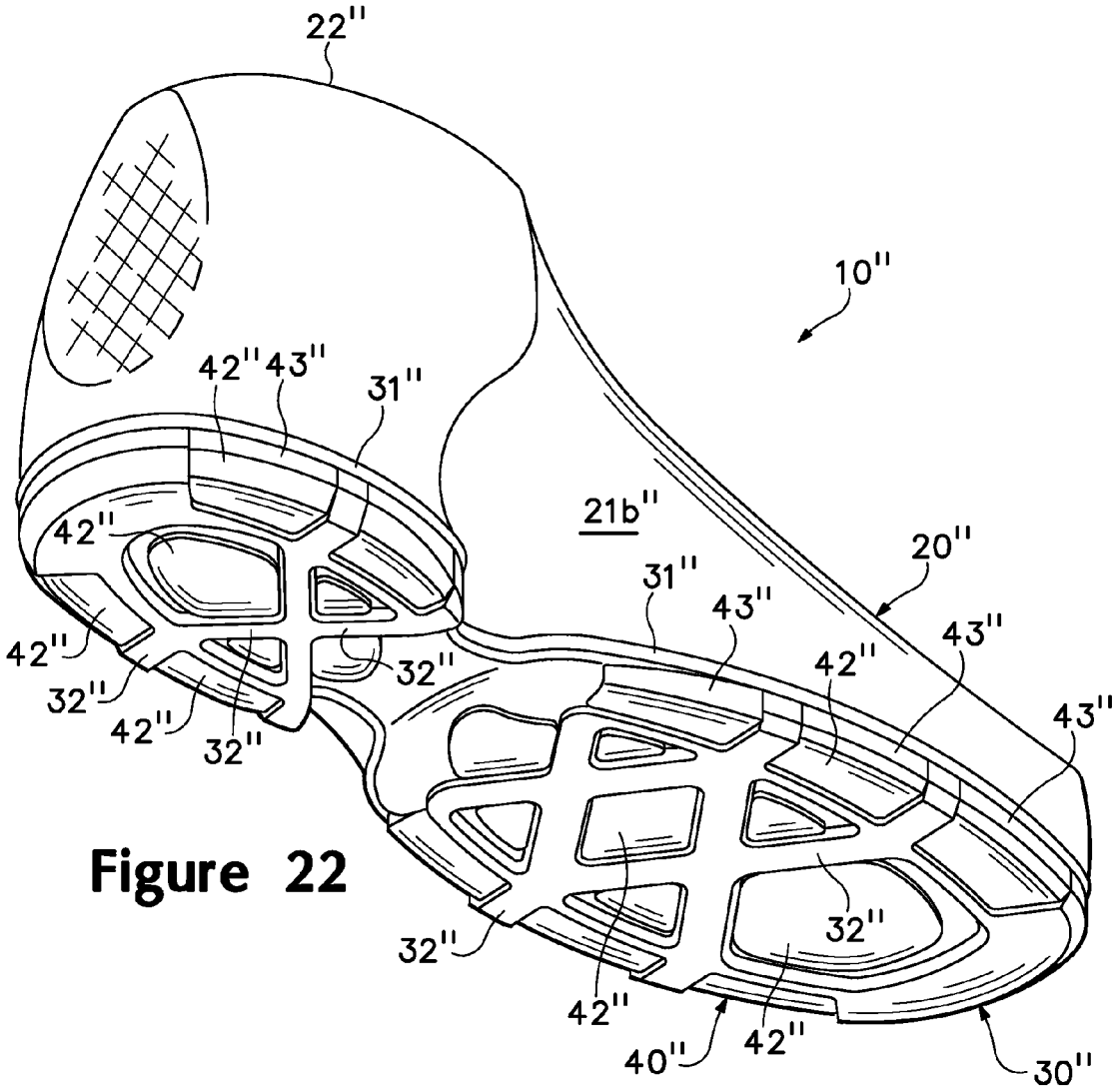
FIG. 22 is a perspective view of the third article of footwear.
Figure 23:
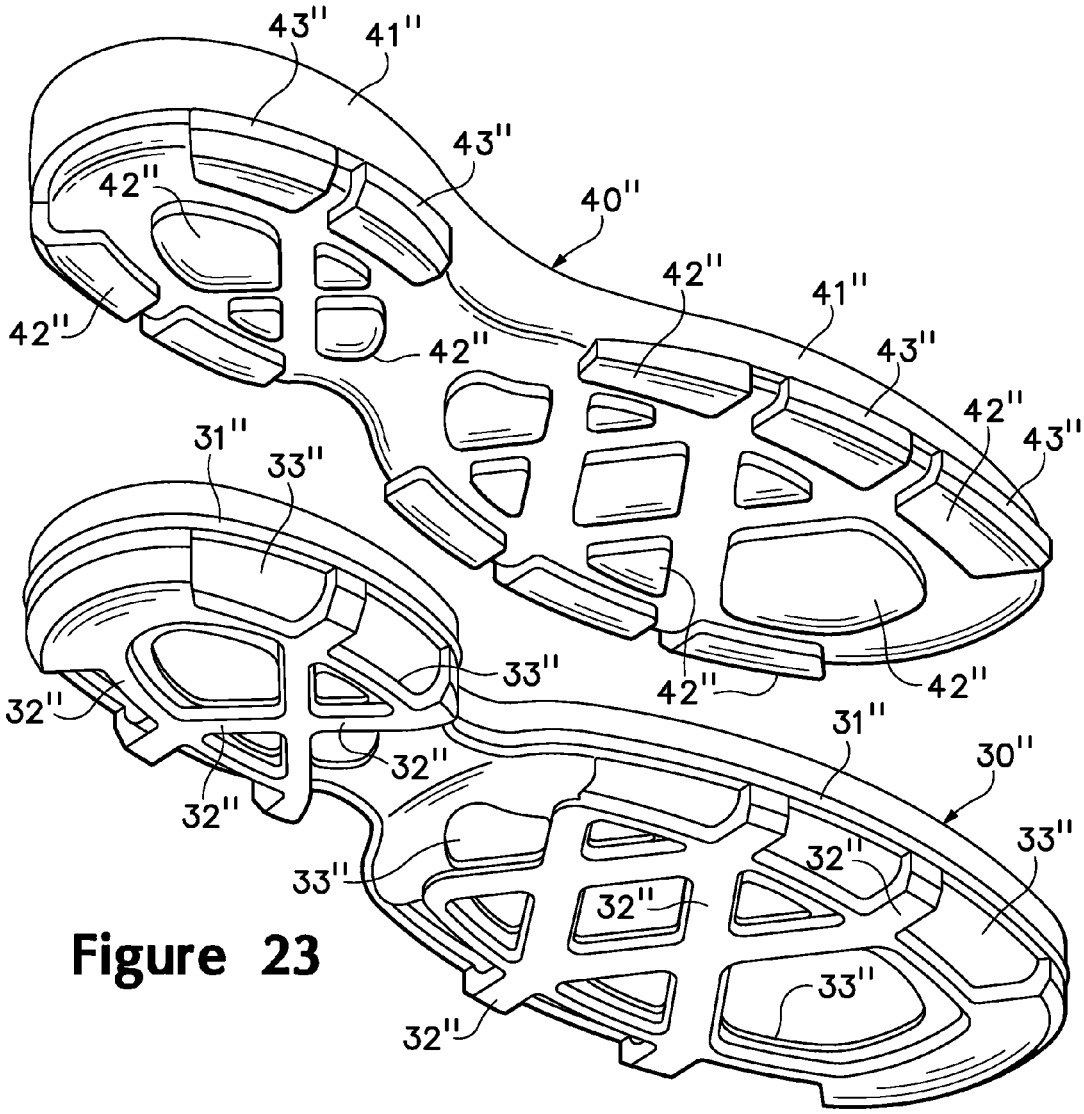
FIG. 23 is an exploded perspective view of the third article of footwear.
Figure 24:
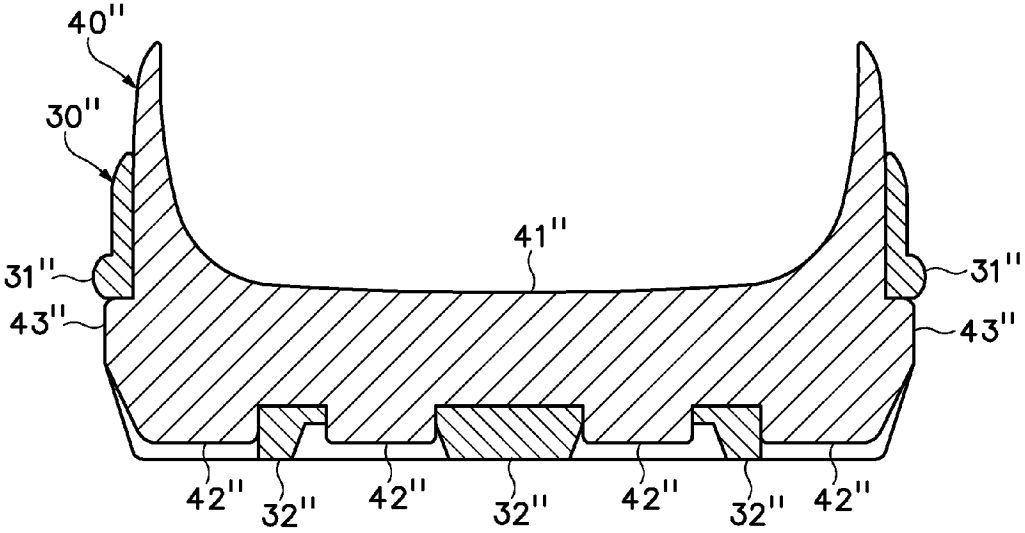
FIG. 24 is a first cross-sectional view of the third article of footwear, as defined by section line 24-24 in FIG. 21.
Figure 25:
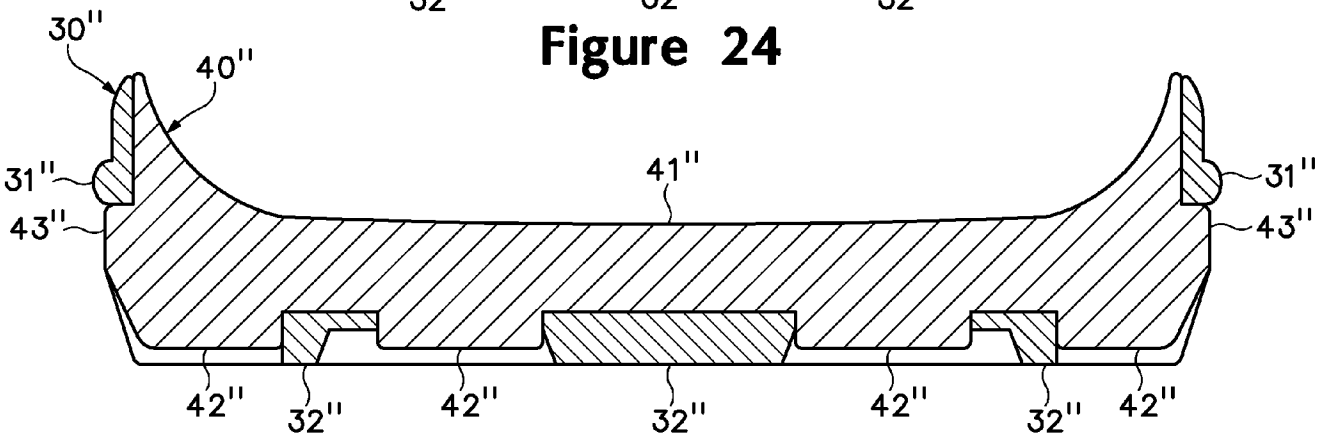
FIG. 25 is a third cross-sectional view of the third article of footwear, as defined by section line 25-25 in FIG. 21.

Some of segments 34' extend outward to form extensions of outsole 33'. These segments 34' extend to side surfaces of midsole 32' and may extend upward along the side surfaces of midsole 32', as depicted in FIG. 19C. As with the lower surface of midsole 32', these segments 34' may protrude or otherwise extend outward from the side surfaces of midsole 32' to resist wear of the side surfaces of midsole 32'.

Outsole 33' also has a pair of cover members 36' that extend over the lower surface of various sole elements 51'. One of cover members 36' is located in the heel region of footwear 10' to resist wear that occurs upon footstrike (i.e., initial contact between footwear 10' and the ground). Another one of cover members 36' is located in the forefoot region of footwear 10' and extends along a front of the forefoot region and along a medial side of the forefoot region. The locations of these two cover members 36' provides an example of the various locations where similar cover members may be located. As depicted in the Figures, many of sole elements 51' have an exposed lower surface. In order to enhance the wear properties of the lower surfaces of sole elements 51' a plurality of outsole elements may be secured to the lower surface of selected sole elements 51'. Furthermore, traction properties of footwear 10' may be enhanced by texturing segments 34' or cover members 36'.

Midsole 32' and outsole 33' are joined through a mechanical interface rather than an adhesive or chemical interface. As discussed above, the side surfaces of sole elements 51' form indentations, and the T-shaped segments 34' extend into the indentations. Additionally, outsole 33' extends around sole elements 51'. This interface between midsole 32' and outsole 33' is generally sufficient to secure midsole 32' and outsole 33' together. In some embodiments, however, adhesives or other means of joining midsole 32' and outsole 33' may be utilized.

The conventional sole structure, as discussed above, may have a relatively stiff or inflexible construction that inhibits the natural motion of the foot. For example, the foot may attempt to flex during the stage of the running cycle when the heel leaves the ground. The combination of the inflexible midsole construction and a conventional heel counter operates to resist flex in the foot. In contrast, footwear 10' flexes with the foot, and may have a configuration that does not incorporate a conventional heel counter.

Third Article of Footwear

FIGS. 20-25 disclose yet another article of footwear 10" having an upper 20", an outsole 30", a midsole 40" in accordance with the present invention. Upper 20" is secured to outsole 30" to form a single element. Midsole 40", however, is separable from the combination of upper 20" and outsole 30". This structure provides a plurality of advantages over the conventional, non-separable articles of footwear. For example, either midsole 40" or the combination of upper 20" and outsole 30" may be separately cleansed in a manner that best suits the respective materials forming each component. If one of midsole 40" or the combination of upper 20" and outsole 30" becomes worn or otherwise damaged, the damaged component may be replaced without the necessity of replacing the undamaged component, and the damaged component may be more easily recycled. Furthermore, midsole 40" or the combination of upper 20" and outsole 30" may be interchanged with alternate components to suit a particular activity or a preference of an individual.

Upper 20" exhibits a generally conventional structure incorporating a plurality of elements that are stitched or otherwise connected to form a comfortable structure for receiving the foot. Suitable materials for upper 20" include various textiles, foam, leather, and polymer materials that are stitched or adhesively bonded together. The textile materials, for example may include a mesh cloth that provides enhanced air-permeability and moisture-wicking properties. The foam materials may be a lightweight thermoset foam that conforms to the shape of the foot and enhances the comfort of footwear 10". Finally, the leather and polymer materials may be positioned in high-wear portions of upper 20", or in portions of upper 20" that require additional stretch-resistance or support. In some embodiments, and as depicted in the figures, upper 20" may be primarily formed from a synthetic leather material that is supplemented with woven structures that stretch and conform with the shape of the foot. Accordingly, upper 20" may be manufactured from generally conventional materials.

The various elements forming upper 20" define a lateral side **21*a*", an opposite medial side 21*b*", and an ankle opening 22". Lateral side 21*a*" and medial side 21*b*" generally cover the sides, heel, and instep portion of the foot, and may include laces or another adjustment system for tightening upper 20" around the foot and securing the foot within footwear 10. Lateral side 21*a*" and medial side 21*b*" define ankle opening 22" and extend downward from ankle opening 22" to join with outsole 30". Ankle opening 22" provides access to a void within upper 20" that accommodates both midsole 40" and the foot. Lateral side 21*a*", medial side 21*b*", and ankle opening 22" have, therefore, a generally conventional configuration. As discussed above, midsole 40" is separable from the combination of upper 20" and outsole 30". Ankle opening 22" may provide, therefore, access to the void within upper 20" and also an area for removing and inserting midsole 40"**.

Outsole 30" may be permanently secured to a lower portion of upper 20" to form a lower, ground-engaging surface of footwear 10". A variety of attachment techniques may be utilized for permanently securing outsole 30" to lateral side **21*a*" and medial side 21*b*", including stitching, adhesive bonding, thermobonding, or a combination of stitching and bonding, for example. Outsole 30" may be a single element or a plurality of elements that are joined together. Suitable materials for outsole 30"** include any of the various abrasion-resistant rubber materials that are conventionally utilized in footwear outsoles, including blown rubber, carbon rubber, or a combination of blown and carbon rubbers. The term "permanently secured" encompasses various securing techniques (e.g. stitching, adhesives, and thermobonding) that a consumer is not intended to modify.

Outsole 30" includes a rim section 31" and a plurality of elements 32" that define multiple apertures 33". Rim section 31" extends around the periphery of outsole 30" and is joined with upper 20", thereby permanently joining upper 20" and outsole 30" together. Elements 32" are relatively thin members that extend across a lower surface of footwear 10" to provide portions of outsole 30" that engage the ground. More particularly, elements 32" generally extend from lateral side **21*a*" to medial side 21*b*" and may be spaced to define the various apertures 33" and expose a lower surface of midsole 40". That is, elements 32" generally form a web structure in outsole 30". As depicted in the figures, apertures 33" exhibit generally rectangular, triangular, and diamond-shaped configurations. In further embodiments of the invention, apertures 33" may exhibit a variety of other shapes or combinations of shapes, including circular, oval, hexagonal, octagonal, square, or other geometrical or non-geometrical shapes. Accordingly, the specific shape of apertures 33"** may vary considerably within the scope of the present invention.

Figure 26:
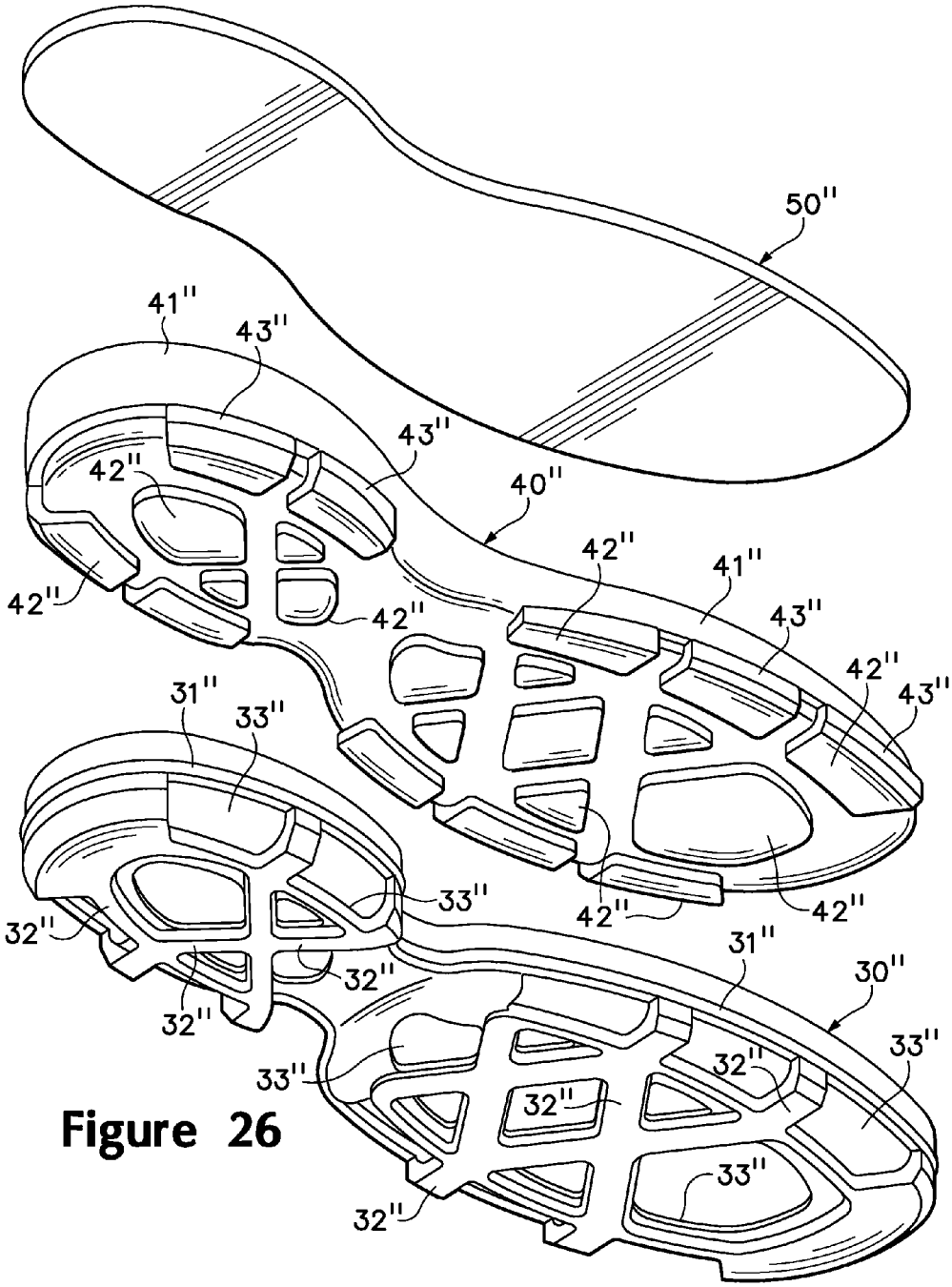
FIG. 26 is an exploded perspective view of another embodiment of the third article of footwear.

Midsole 40" is separable from the combination of upper 20" and outsole 30" by disengaging midsole 40" from outsole 30" and drawing midsole 40" through ankle opening 22", thereby removing midsole 40" from the void formed within upper 20". The primary elements of midsole 40" are a foot-supporting portion 41" and a plurality of projections 42". Foot-supporting portion 41" extends from a heel portion to a forefoot portion of footwear 10" and provides an upper surface for contacting and supporting the foot. The upper surface of foot-supporting portion 41" may be contoured to conform with a natural shape of the foot. Peripheral areas of foot-supporting portion 41' may also be raised to form a general depression in the upper surface of midsole 40", thereby providing an area for securely receiving the foot. In order to enhance the comfort of midsole 40", a generally conventional insole 50" may extend over the upper surface of foot-supporting portion 41", as depicted in FIG. 26. That is, insole 50" may be positioned to extend between midsole 40" and the foot, and insole 50" may also be removable in the same general manner as midsole 40".

A lower surface of foot-supporting portion 41" contacts the various elements 32" when midsole 40" is received by the combination of upper 20" and outsole 30". In addition, projections 42" extend downward and into apertures 33". Projections 42" exhibit the general shape of apertures 33". Those projections 42" that are located in peripheral areas of midsole 40" may include a flange 43" that extends under rim section 31" to secure midsole 40" in position relative to outsole 30". In addition to extending downward, those projections 42" that are located in peripheral areas of midsole 40" also extend laterally to form flanges 43". In combination with outsole 30", flanges 43" extend under rim section 31" to secure the position of midsole 40".

Midsole 40" is formed of a polymer foam material that provides cushioning as footwear 10" contacts the ground. More specifically, midsole 40" operates to attenuate ground reaction forces and absorb energy as midsole 40" is compressed between the foot and the ground. This may occur, for example, during various ambulatory activities that involve either walking or running. Suitable materials for midsole 40" may be any of the conventional polymer foams that are utilized in the midsoles of athletic footwear, such as ethylvinylacetate and polyurethane foam. Midsole 40" may also incorporate a fluid-filled bladder in the heel portion or along the entire length of foot-supporting portion 41" in order to provide additional cushioning, as disclosed in U.S. Pat. Nos. 4,183,156; 4,219,945; 4,906,502; and 5,083,361 to Marion F. Rudy and U.S. Pat. Nos. 5,993,585 and 6,119,371 to David A. Goodwin et al.

When midsole 40" is properly positioned within upper 20" and joined with outsole 30", projections 42" extend downward and into apertures 33". The shapes of projections 42" generally correspond with the shapes of apertures 33" to provide a secure connection between outsole 30" and midsole 40". The secure connection ensures, for example, that midsole 40" remains properly positioned relative to upper 20" during walking, running, or other ambulatory activities. The secure connection also ensures that debris (e.g., dirt, stones, twigs) do not enter upper 20" through apertures 33". In order to enhance the secure connection, flanges 43" extend under rim section 31", as discussed above. The combination of flanges 43" and rim section 31" discussed above provides an example of a mechanical locking system that is suitable for footwear 10". In some embodiments, a locking system may not be necessary to form a secure connection between sole structure 30" and upper 20". In other embodiments, a friction fit between outsole 30" and midsole 40", various pins that extend through outsole 30" and into midsole 40", or a temporary adhesive may be utilized. Accordingly, the use of an aperture edge and flange (i.e., rim section 31" and flanges 43") is not the only type of mechanical locking system that may be utilized to form a secure connection between sole structure 30" and upper 20".

Projections 42" extend downward and into apertures 33", and projections 42" are exposed by apertures 33". Although projections 42" extend downward and into apertures 33" and are exposed, a lower surface of the various projections 42" remains at a higher elevation than a lower surface of elements 32". This configuration ensures that outsole 30" is the primary element of footwear 10" that contacts or otherwise engages the ground. For example, the lower surface of the various projections 42" was at a lower elevation than the lower surface of elements 32", then midsole 40" would provide the primary ground-engaging element of footwear 10" and would be subject to considerable abrasive forces. As discussed above, outsole 30" may be formed from an abrasion-resistant rubber material and midsole 40" may be formed from a polymer foam. Outsole 30" is, therefore, formed from a material that is more capable of withstanding the abrasive forces associated with walking, running, or other ambulatory activities. In some embodiments of the invention, the lower surface of projections 42" may be covered by an abrasion-resistant material to enhance the durability of midsole 40".

Although the lower surface of the various projections 42" remains at a higher elevation than a lower surface of elements 32", the lower surface of the various projections 42" may still contact the ground as outsole 30" and midsole 40" are compressed between the foot and the ground. A majority of the abrasive forces associated with walking, running, or other ambulatory activities may still be absorbed by outsole 30". Accordingly, the difference in elevations between outsole 30" and the lower surface of the various projections 42" is not intended to prevent midsole 40" from contacting the ground. Rather, the difference in elevations may operate to limit the degree to which the abrasive forces wear or otherwise degrade midsole 40".

The structure of footwear 10" described above provides a variety of advantages over conventional footwear, wherein the sole may be permanently attached to the upper. During running, for example, some individuals may prefer a sole structure that limits the degree to which the foot pronates upon contact with the ground. The same individual, however, may prefer a sole structure that exhibits a high degree of stability during court-style activities, such as basketball or tennis. Rather than purchase multiple pairs of upper-sole structure combinations that are permanently secured together, the individual may acquire the combination of upper 20" and outsole 30", and the individual may acquire multiple midsoles 40", each midsole 40" being suitable for different activities. The individual may then select one of the multiple midsoles 40" for use with the combination of upper 20" and outsole 30". Similarly, the individual may acquire multiple combinations of upper 20" and outsole 30" for use with a single midsole 40".

The combination of upper 20" and outsole 30" may include different materials than midsole 40. Whereas midsole 40" may be formed primarily from a polymer foam material, the combination of upper 20" and outsole 30" may be formed from different materials. The respective portions of footwear 10" may benefit from cleansing techniques that are specifically suited to their respective materials. Accordingly, the combination of upper 20" and outsole 30" may be separated from midsole 40" and each may be cleansed in an appropriate manner.

Midsole 40" is formed from a polymer foam material. Following significant use, the various cells within the polymer foam material may experience compression set or otherwise degrade, or midsole 40" may become significantly worn. Rather than dispose of footwear 10", midsole 40" may be properly recycled and replaced with an alternate midsole 40", thus extending the lifespan of footwear 10". Similar considerations apply to the combination of upper 20" and outsole 30".

The midsole often comprises a significant portion of footwear 10" and many conventional articles of footwear. As discussed above, the midsole of conventional articles of footwear is permanently secured to the upper and outsole. This configuration increases the difficulty of recycling the midsole or other footwear components. In footwear 10", however, midsole 40" is separable from the combination of upper 20" and outsole 30". In comparison with the conventional footwear, therefore, midsole 40" may be recycled with significantly greater efficiency.

From an aesthetic viewpoint, the interchangeability of midsole 40" and the combination of upper 20" and outsole 30" also provides the individual with the ability to customize the appearance of footwear 10". For example, footwear 10" may be purchased with a first color combination. By interchanging midsole 40" with an alternate midsole 40", for example, the color combination of footwear 10" may be customized to the preferences of the individual. Support for a particular athletic team, for example, may also be demonstrated by selecting midsole 40" and the combination of upper 20" and outsole 30" to reflect the colors of the athletic team.

CONCLUSION

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

That which is claimed is:

1. An article of footwear having an upper and a sole structure engaged with the upper, the sole structure comprising:

a connecting portion positioned adjacent the upper and extending along a longitudinal length of the upper;

a plurality of sole elements extending away from the connecting portion, the sole elements each defining an end surface, and the sole elements being separated by a plurality of grooves that extend in a direction from the end surface and into the sole structure toward the connecting portion; and an outsole located within the grooves and extending between the sole elements, an exterior portion of the outsole extending beyond the end surfaces of the sole elements to form at least a portion of a ground-contacting surface of the sole structure, a gap being formed in an upper portion of the grooves above the outsole, the outsole defining a plurality of apertures that extend around the sole elements.

2. The article of footwear recited in claim 1, wherein the outsole has a web configuration.

3. The article of footwear recited in claim 1, wherein side surfaces of the sole elements form indentations, and the outsole extends into the indentations.

4. The article of footwear recited in claim 1, wherein segments of the outsole exhibit a T-shaped configuration in cross-section.

5. The article of footwear recited in claim 1, wherein a cover portion of the outsole extends over the end surfaces of at least a portion of the sole elements.

6. The article of footwear recited in claim 5, wherein the cover portion is located in a heel region of the footwear.

7. The article of footwear recited in claim 5, wherein the cover portion is located in a forefoot region of the footwear, and a portion of the cover portion extends along a medial side of the sole structure.

8. The article of footwear recited in claim 1, wherein the outsole is configured to be a single piece.

9. The article of footwear recited in claim 1, wherein extension portions of the outsole extend along side areas of the sole structure.

10. The article of footwear recited in claim 1, wherein a first group of the grooves extend in a longitudinal direction that corresponds with a direction between a forefoot region and a heel region of the footwear, and a second group of the grooves extend in a lateral direction that corresponds with a direction between a medial side and a lateral side of the footwear.

11. An article of footwear having an upper and a sole structure engaged with the upper, the sole structure comprising:

a connecting portion positioned adjacent the upper and extending along a longitudinal length of the upper;

a plurality of sole elements extending from the connecting portion, the sole elements each defining an end surface, and the sole elements being separated by a plurality of grooves that extend in a direction from the end surface and into the sole structure toward the connecting portion, the plurality of grooves including:

a first groove oriented in a longitudinal direction with respect to the footwear, the first groove extending through a length of the sole structure, and the first groove being spaced inward from a lateral side and a medial side of the sole structure, and a plurality of second grooves that extend laterally from the medial side to the lateral side of the sole structure; and an outsole located within the first groove and the plurality of second grooves to extend between the sole elements, an exterior portion of the outsole extending beyond the end surfaces of the sole elements to form at least a portion of a ground-contacting surface of the sole structure, a gap being formed in an upper portion of each of the first and second grooves above the outsole.

12. The article of footwear recited in claim 11, wherein the outsole is configured to be a single piece having a web configuration defining a plurality of apertures that extend around the sole elements.

13. The article of footwear recited in claim 11, wherein side surfaces of the sole elements form indentations, and the outsole extends into the indentations.

14. The article of footwear recited in claim 11, wherein segments of the outsole exhibit a T-shaped configuration in cross-section.

15. The article of footwear recited in claim 11, wherein a cover portion of the outsole extends over the end surfaces of at least a portion of the sole elements.

16. An article of footwear having an upper and a sole structure engaged with the upper, the sole structure comprising:

a connecting portion positioned adjacent the upper and extending along substantially an entire longitudinal length of the upper;

a plurality of sole elements extending from the connecting portion, the sole elements being separated by a plurality of grooves that extend into the sole structure and toward the connecting portion; and an outsole located within the grooves and extending between the sole elements, a gap being formed in an upper portion of the grooves above the outsole, the outsole defining a plurality of apertures that extend around the sole elements.

17. The article of footwear recited in claim 16, wherein an exterior portion of the outsole extends beyond end surfaces of the sole elements to form at least a portion of a ground-contacting surface of the sole structure.

18. The article of footwear recited in claim 16, wherein the outsole is configured to be a single piece having a web configuration.

19. The article of footwear recited in claim 16, wherein side surfaces of the sole elements form indentations, and the outsole extends into the indentations.

20. The article of footwear recited in claim 16, wherein a first group of the grooves extend in a longitudinal direction that corresponds with a direction between a forefoot region and a heel region of the footwear, and a second group of the grooves extend in a lateral direction that corresponds with a direction between a medial side and a lateral side of the footwear.

21. The article of footwear recited in claim 16, wherein the plurality of grooves includes:

a first groove oriented in a longitudinal direction with respect to the footwear, the first groove extending through a length of the sole structure, and the first groove being spaced inward from a lateral side and a medial side of the sole structure; and a plurality of second grooves that extend laterally from the medial side to the lateral side of the sole structure.

22. An article of footwear having an upper and a sole structure engaged with the upper, the sole structure comprising:

a midsole including:

(a) a connecting portion positioned adjacent the upper and extending along a longitudinal length of the upper and (b) a plurality of sole elements extending away from the connecting portion, the sole elements each defining an end surface, and the sole elements being separated by a plurality of grooves that extend in a direction from the end surface and into the sole structure toward the connecting portion; and an outsole located within the grooves and extending between the sole elements of the midsole, an exterior portion of the outsole extending beyond the end surfaces of the sole elements to form at least a portion of a ground-contacting surface of the sole structure, a gap being formed in an upper portion of the grooves above the outsole, the outsole defining a plurality of apertures that extend around the sole elements.

23. An article of footwear having an upper and a sole structure engaged with the upper, the sole structure comprising:

a midsole including:

(a) a connecting portion positioned adjacent the upper and (b) a plurality of sole elements extending from the connecting portion, the sole elements being separated by a plurality of grooves that extend into the sole structure and toward the connecting portion; and an outsole located within the grooves and extending between the sole elements of the midsole, a gap being formed in an upper portion of the grooves above the outsole, the outsole defining a plurality of apertures that extend around the sole elements.

* * * * *